US007275882B2

(12) United States Patent
Ishikawa et al.

(10) Patent No.: US 7,275,882 B2
(45) Date of Patent: Oct. 2, 2007

(54) IMAGE RECORDING APPARATUS

(75) Inventors: Kan Ishikawa, Toyoake (JP); Noriyuki Kawamata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 368 days.

(21) Appl. No.: 11/072,508

(22) Filed: Mar. 7, 2005

(65) Prior Publication Data

US 2005/0196214 A1 Sep. 8, 2005

(30) Foreign Application Priority Data

Mar. 8, 2004 (JP) ..... 2004-064630

(51) Int. Cl.
*B41J 19/00* (2006.01)

(52) U.S. Cl. ..... 400/238; 400/352; 347/37

(58) Field of Classification Search ..... 400/283, 400/352; 347/37

See application file for complete search history.

(56) References Cited

U.S. PATENT DOCUMENTS

| | | | | |
|---|---|---|---|---|
| 6,789,966 | B2 | 9/2004 | Tanaka et al. | |
| 2002/0146266 | A1 | 10/2002 | Tanaka et al. | |
| 2003/0076379 | A1 | 4/2003 | Yusef et al. | |
| 2005/0206667 | A1 * | 9/2005 | Ohama et al. | 347/9 |

FOREIGN PATENT DOCUMENTS

| | | |
|---|---|---|
| EP | 1 574 351 | 9/2005 |
| JP | 05-270091 | 10/1993 |
| JP | 5-270091 | 10/1993 |
| JP | 7-266654 | 10/1995 |
| JP | 8-216474 | 8/1996 |
| JP | 11-78147 | 3/1999 |
| JP | 3009787 | 12/1999 |
| JP | 2002-25476 | 9/2002 |

OTHER PUBLICATIONS

European Search Report for Application No. 05 25 1357, completed Jul. 7, 2005.

European Patent Office Action, Application No. 05 251 357.9, dated Jan. 15, 2007.

* cited by examiner

*Primary Examiner*—Daniel J. Colilla
*Assistant Examiner*—Marissa Ferguson-Samreth
(74) *Attorney, Agent, or Firm*—Banner & Witcoff, Ltd.

(57) ABSTRACT

An image recording apparatus includes: a first guide member having a first sliding surface; a second guide member having another first sliding surface; and a carriage being supported by the first sliding surfaces of the first and second guide members. The carriage includes first sliding convex parts protruding from a lower surface side thereof and coming in contact with the first sliding surfaces of the first and second guide members, and a coming-out preventing pawl disposed to hold at least one of the first and second guide members in cooperation with the first sliding convex part. At least one of the first and second guide members includes a notch part at a specified position, and the carriage is detachable from the first and second guide members by causing the coming-out preventing pawl to pass through the notch part.

18 Claims, 19 Drawing Sheets

FIG. 18A
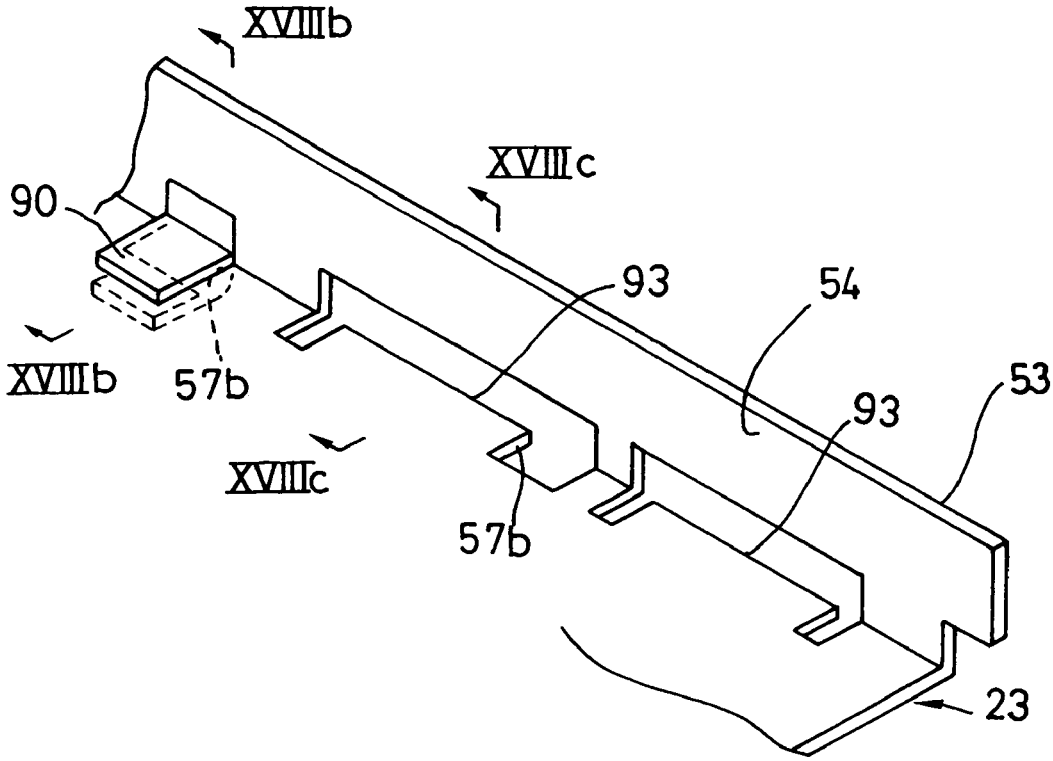
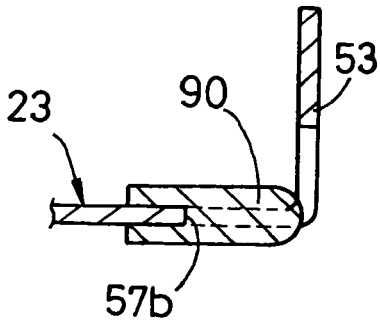
FIG. 18B
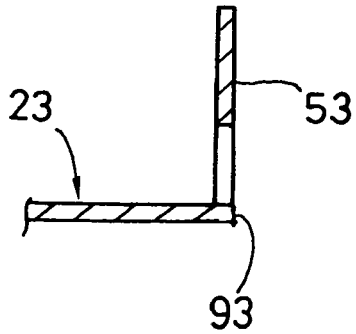
FIG. 18C

IMAGE RECORDING APPARATUS

BACKGROUND OF THE INVENTION

1. Field of the Invention

The present invention relates to an image recording apparatus of an ink-jet type or the like, and more particularly to a structure of a supporting device of a carriage on which a recording head is mounted.

2. Description of the Related Art

A dominating conventional image recording apparatus is such that for example, as disclosed in JP-A-5-270091 (see FIGS. 1 to 4), in order to support a carriage carrying a recording head in such a manner that it can reciprocate in a main scanning direction, the carriage is slidably supported by a cylindrical guide shaft.

According to the cylindrical guide shaft, because of excellent size accuracy, high rigidity, a variation of a so-called paper gap between the nozzle surface of the recording head and the surface of a recording medium can be made small, and a high quality recording image can be easily obtained, however, the cost is high. Besides, when the carriage is detached from the guide shaft for maintenance, exchange or the like, the guide shaft is first detached from a frame, and further, the carriage must be detached from the guide shaft, while a procedure opposite thereto must be carried out at the time of assembly. Thus, there is a problem that the mounting of the carriage is very difficult.

For the purpose of reducing the cost, in JP-A-2002-254746 (see FIG. 2), a first carriage guide plate having a Z-shaped section is formed by cutting and raising at a halfway part, in the height direction, of a main frame provided to stand in the vertical direction, and a first guide part protruded downward from one lower surface of a carriage is brought into contact with an upper surface of a horizontal first position regulating plate. A third guide part laterally protruded from the lower part of the carriage so as to face the lower surface (sliding surface) of the first guide part is made to face the lower surface of the first position regulating plate.

Besides, at a part protruded downward from a side part of the carriage to have a U shape, a pair of second guide parts are provided to hold both the front and back surfaces of a second position regulating plate obtained by bending the tip of the first position regulating plate vertically upward.

Further, the lower surface (sliding surface) of a fourth guide part protruded downward from the other lower surface of the carriage is brought into contact (slide contact) with a third position regulating surface (upper surface) of the horizontal second carriage guide plate.

SUMMARY OF THE INVENTION

However, in the structure of JP-A-2002-254746, the horizontal first position regulating plate of the first carriage guide plate is sandwiched between the first guide part and the third guide part in the vertical direction, and both the surfaces of the vertical second position regulating plate provided to be coupled with the first position regulating plate is sandwiched between the pair of second guide parts in the horizontal direction. Thus, in order to detach the carriage from the first carriage guide plate, it becomes necessary to perform such an operation as to detach the lower third guide part from the carriage, and there is a problem that the attachment/detachment operation of the carriage relative to the carriage guide plate is difficult.

The present invention provides an image recording apparatus in which a guide shaft is not used, an attachment/detachment operation of a carriage is easy, and manufacturing cost can be reduced.

According to one aspect of the invention, there is provided an image recording apparatus including: a first guide member disposed at an upstream side in a transportation direction of a recording medium, the first guide member having a substantially horizontal upper surface that includes a first sliding surface; a second guide member disposed at a downstream side in the transportation direction, the second guide member having a substantially horizontal upper surface that includes another first sliding surface; and a carriage on which a recording head capable of recording an image on the recording medium is mounted and which reciprocates in a main scanning direction, the carriage being supported by the first sliding surfaces of the first and second guide members which are parallel to a head surface of the recording head, the carriage including first sliding convex parts protruding from a lower surface side thereof and coming in contact with the first sliding surfaces of the first and second guide members, and a coming-out preventing pawl disposed to hold at least one of the first and second guide members in cooperation with the first sliding convex part; wherein at least one of the first and second guide members includes a notch part at a specified position, and the carriage is detachable from the first and second guide members by causing the coming-out preventing pawl to pass through the notch part.

Since the first sliding convex part protruding from the lower surface side of the carriage comes in contact with the first sliding surfaces of the respective upper surfaces of the horizontal first and second guide member, the carriage can be moved in the main scanning direction in a state where it is supported on both of the guide members by only the weight of the carriage. Since the carriage includes the coming-out preventing pawl to hold the back surface (lower surface side) of at least one of the first and second guide members, the carriage is not detached from the guide members at the time of movement. Only at the time when the coming-out preventing pawl is positioned at the notch part provided at the specified position, the carriage can be easily detached from the guide members. Thus, it is unnecessary to remove the coming-out preventing pawl from the carriage, and there is obtained an effect that the structure becomes very simple, and the cost can be reduced.

According to another aspect of the invention, there is provided an image recording apparatus including: a first guide member disposed at an upstream side in a transportation direction of a recording medium which is orthogonal to a main scanning direction, the first guide member having a substantially horizontal upper surface that includes a first sliding surface; a second guide member disposed at a downstream side in the transportation direction, the second guide member having a substantially horizontal upper surface that includes another first sliding surface and a second sliding surface provided to stand substantially orthogonally to the first sliding surface; and a carriage on which a recording head capable of recording an image on the recording medium is mounted and which reciprocates in the main scanning direction, the carriage being supported by the first sliding surfaces of the first and second guide members which are parallel to a head surface of the recording head, the carriage including first sliding convex parts protruding from a lower surface side thereof and coming in contact with the first sliding surfaces of the first and second guide members, coming-out preventing pawls disposed to hold the first and second guide members in cooperation with the respective first sliding convex parts, a second sliding convex part coming in sliding contact with the second sliding surface, a third sliding convex part that is opposite to the second sliding convex part across the second sliding surface, and an elastic member to elastically urge the third sliding convex part toward a direction of the second sliding surface; where in the first and second guide members include, at specified positions, notch parts to enable the respective coming-out preventing pawls to be detached in a direction crossing the main scanning direction of the carriage.

When the carriage is moved along the first and second guide members, the carriage does not float and can be accurately moved with reference to the second sliding surface. Even if the first sliding surface and the second sliding surface orthogonal to each other exist on the second guide member, there is obtained an effect that the carriage can be easily detached from the guide members at the specified position and can be exchanged without removing the coming-out preventing pawl provided on the carriage.

BRIEF DESCRIPTION OF THE DRAWINGS

The present invention may be more readily described with reference to the accompanying drawings:

FIG. 18A is a perspective view showing a notch part of a second guide member, FIG. 18B is a sectional view taken along line XVIIIb-XVIIIb of FIG. 18A, and FIG. 18C is a sectional view taken along line XVIIIc-XVIIIc of FIG. 18A.

DETAILED DESCRIPTION OF THE PREFERRED EMBODIMENTS

Now, an embodiment of the invention will be described.

Figure 1:
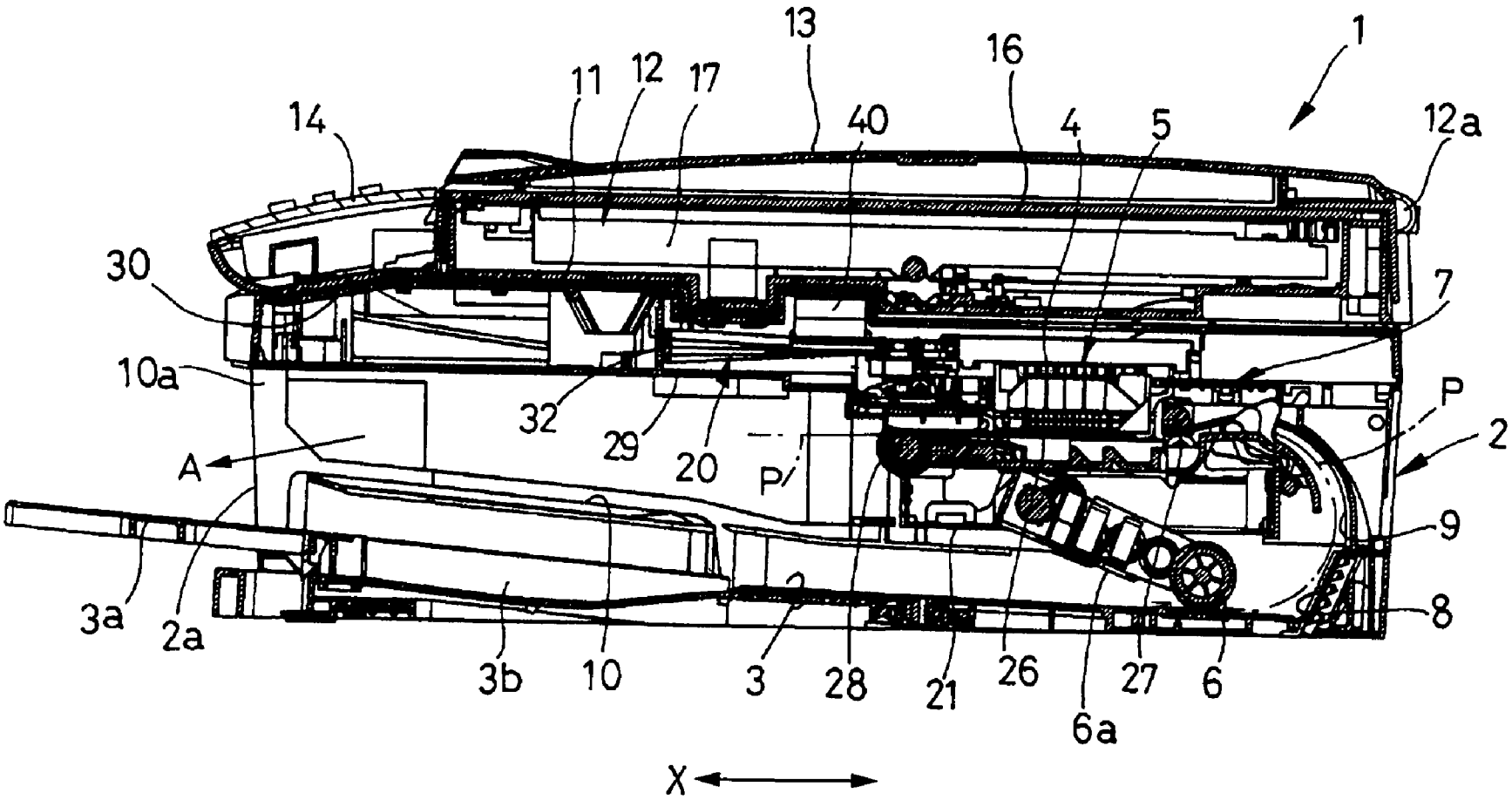
FIG. 1 is a side sectional view of an image recording apparatus of an embodiment of the invention.

An image recording apparatus 1 of this embodiment is a multi function device (MFD) having a printer function, a copy function, a scanner function and a facsimile function, to which the invention is applied. As shown in FIG. 1, at a bottom part of a recording apparatus main body 2 made of synthetic resin, a paper feed cassette 3 is disposed which can be inserted through an opening part 2*a* at the front side (left side in FIG. 1) of the recording apparatus main body 2.

In this embodiment, the paper feed cassette 3 is made to have such a form that plural sheets P, each of which is a recording medium and is cut into, for example, A4 size, letter size, legal size, postcard size or the like, can be stacked (deposited) and contained in such a manner that its short side extends in a direction (direction orthogonal to the surface of the sheet of FIG. 1, main scanning direction, or Y-axis direction) orthogonal to a sheet transporting direction (sub-scanning direction or X-axis direction). An auxiliary support member 3*a* to support the rear end part of the long sheet P of legal size or the like is mounted at the front end of the paper feed cassette 3 in such a manner that it can be moved in the X-axis direction. Although FIG. 1 shows a state in which the auxiliary support member 3*a* is disposed at a position where it protrudes toward the outside from the main body 2, in the case where the sheet P of A4 size or the like which can be contained in the paper feed cassette 3 (which does not protrude toward the outside from the opening part 2*a*) is used, the auxiliary support member 3*a* can be housed in a housing part 3*b* in such a manner that it does not block the paper feed.

A bank part 8 for sheet separation is disposed at the depth side (right side in FIG. 1) of the paper feed cassette 3. Besides, an arm 6*a* whose lower end part can swing in the vertical direction is mounted at the side of the recording apparatus main body 2, and the sheet P as the recording medium stacked (deposited) on the paper feed cassette 3 is separated and transported one by one by a paper feed roller 6 provided at the lower end of the arm 6*a* and the bank part 8. The separated sheet P is fed to a recording part 7 provided at an upper side (high position) behind the paper feed cassette 3 through a U-turn path (feed path) 9 directed upward. As described later in detail, the recording part 7 includes a carriage 5 on which an ink-jet recording head 4 to realize the printer function and the like is mounted and which can reciprocate.

A paper discharge part 10 to which the sheet P recorded in the recording part 7 is discharged while its recording surface is turned upward, is formed above the paper feed cassette 3, and a paper discharge port 10*a* communicating with the paper discharge part 10 is opened toward the front of the recording apparatus main body 2.

An image reading device 12 for reading a document in the copy function and the facsimile function is disposed at an upper part of the recording apparatus main body 2. A bottom wall 11 of the image reading device 12 is constructed to overlap from above an upper cover body 30 substantially without a gap. The image reading device 12 is constructed to be capable of opening/closing/swinging vertically with respect to one side end of the recording apparatus main body 2 through a not-shown pivot part. Further, a rear end of a document cover body 13 covering an upper surface of the image reading device 12 is mounted to a rear end of the image reading device 12 so that it can vertically swing about a pivot shaft 12*a*.

An operation panel part 14 including various operation buttons, a liquid crystal display part and the like is provided at the upper side of the recording apparatus main body 2 and in front of the image reading device 12. The recording part 7, the paper discharge part 10 and an ink storage part 15 provided at one side of this paper discharge part 10 are disposed to be positioned in a projection area of the image reading device 12 and the operation panel part 14 when viewed on a plane. In the state where the auxiliary support member 3*a* is housed in the housing part 3*b*, the length of the paper feed cassette 3 in the X-axis direction is almost equal to the length of the image reading device 12 plus the length of the operation panel part 14 in the X-axis direction. Accordingly, since this image recording apparatus 1 becomes a substantially rectangular parallelepiped having a substantially square shape when viewed on a plane, packing becomes easy at a packing time when it is shipped as a product, and a box for the packing can be miniaturized.

A placement glass plate 16 on which a document can be placed after the document cover body 13 is opened upward, is provided on the upper surface of the image reading device 12, and at its lower side, an image scanner device (CIS: Contact Image Sensor) 17 for document reading is provided to be capable of reciprocating in the direction (main scanning direction or Y-axis direction in FIGS. 2 to 6) orthogonal to the paper plane of FIG. 1.

Figure 2:
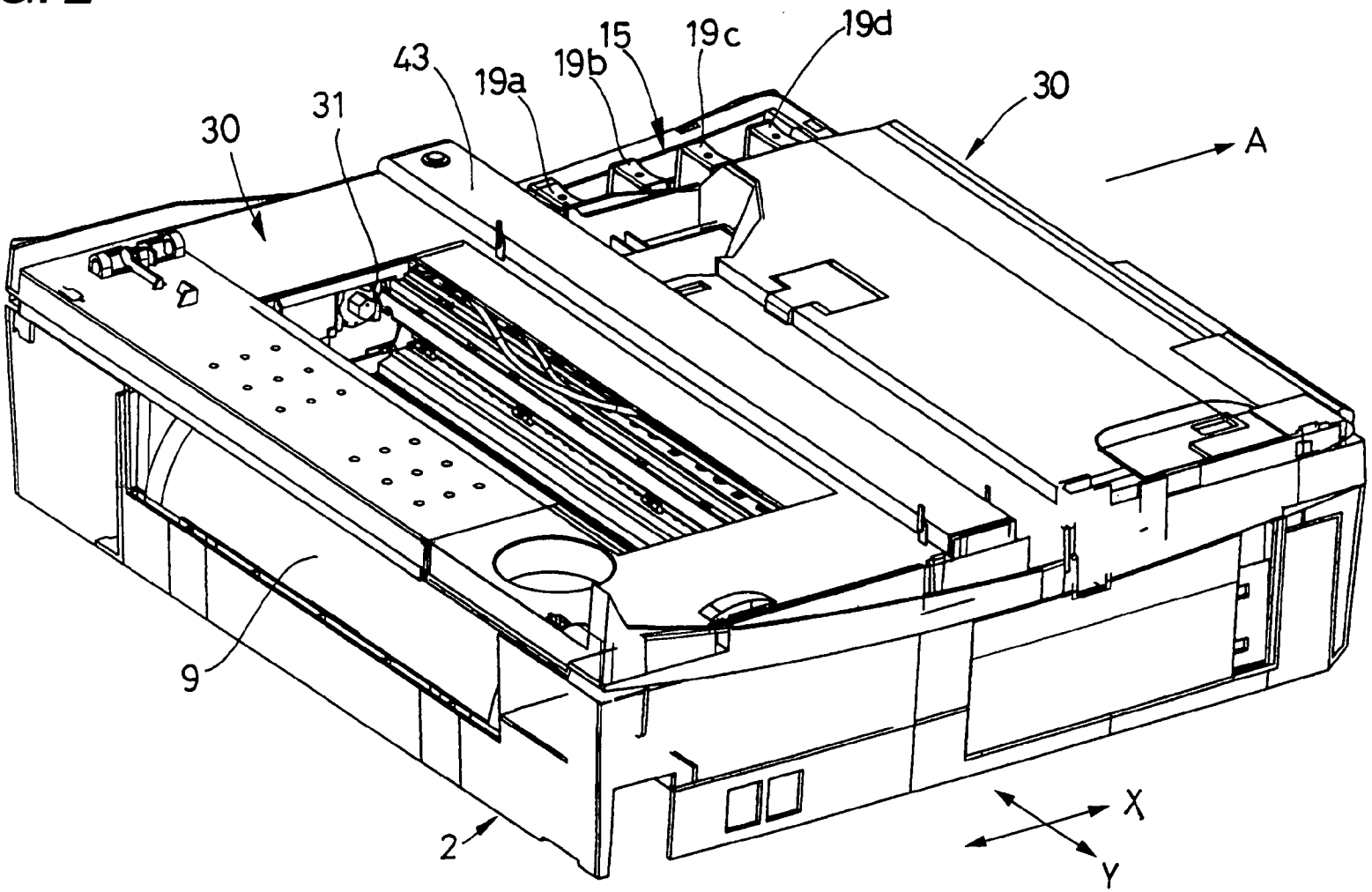
FIG. 2 is a perspective view of a recording apparatus main body.
Figure 3:
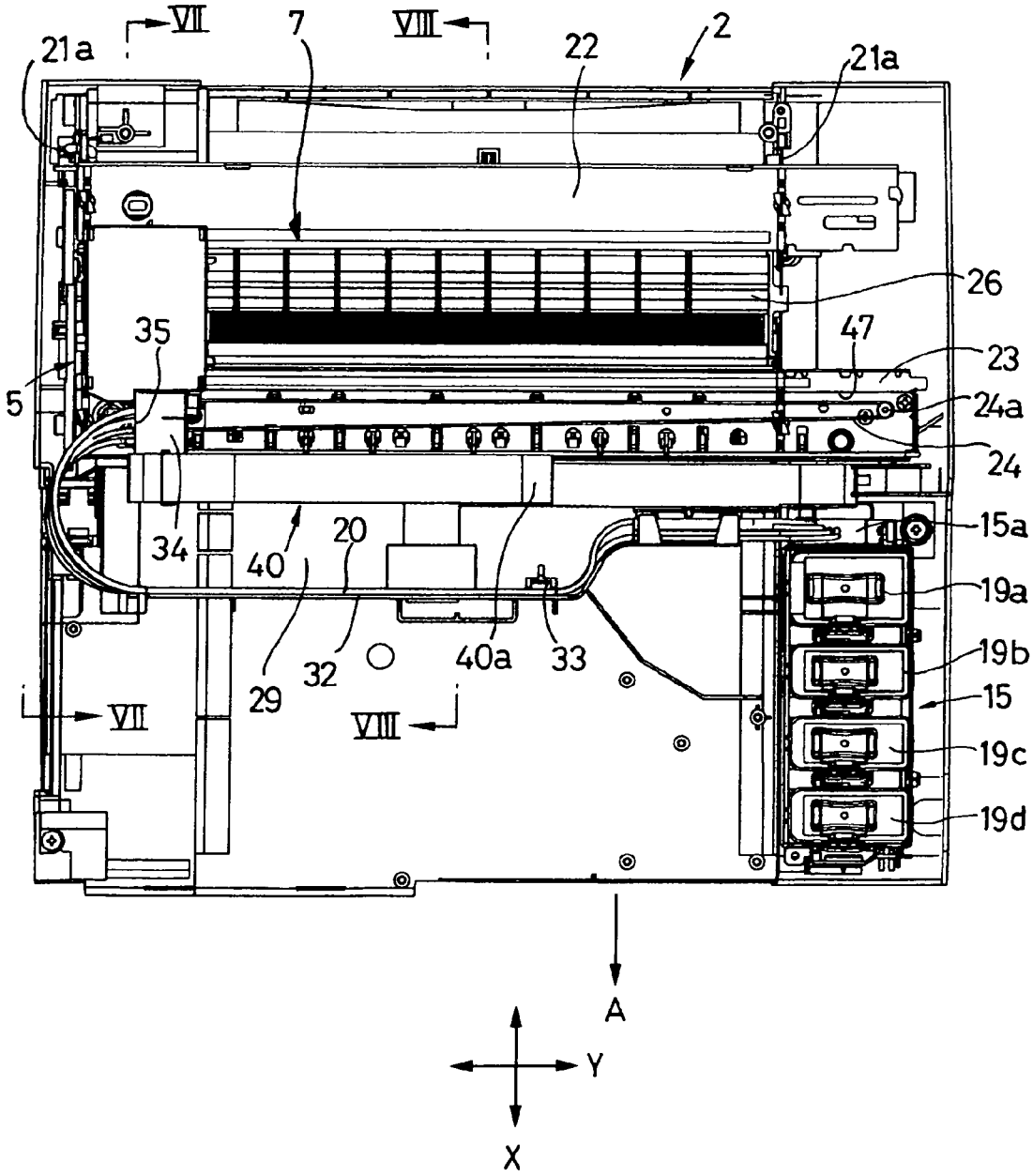
FIG. 3 is a plan view of the recording apparatus main body in a state where an upper cover body is removed.
Figure 4:
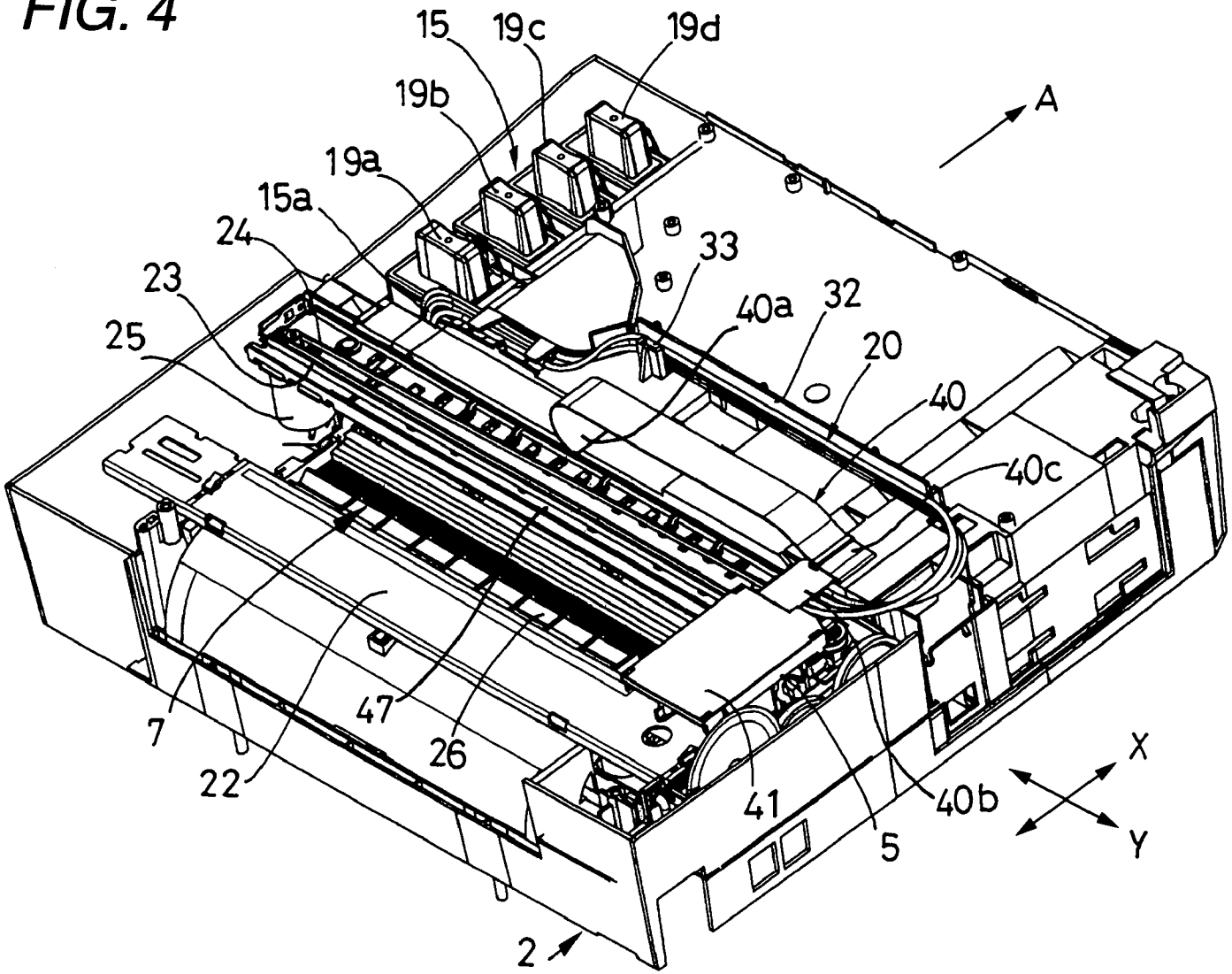
FIG. 4 is a perspective view of the recording apparatus main body in the state where the upper cover body is removed.

The ink storage part 15 is opened toward an upper part of the recording apparatus main body 2, and the ink storage part 15 is constructed such that ink cartridges 19 (cartridges for individual colors, that is, black (BK), cyan (C), magenta (M) and yellow (Y) are denoted by 19*a* to 19*d*, see FIGS. 2 to 4) which respectively contain four color inks for full-color recording, have small areas when viewed on a plane, have high height sizes, and have substantially rectangular box shapes can be housed along the X-axis direction, and can be detachably attached from above.

Figure 7:
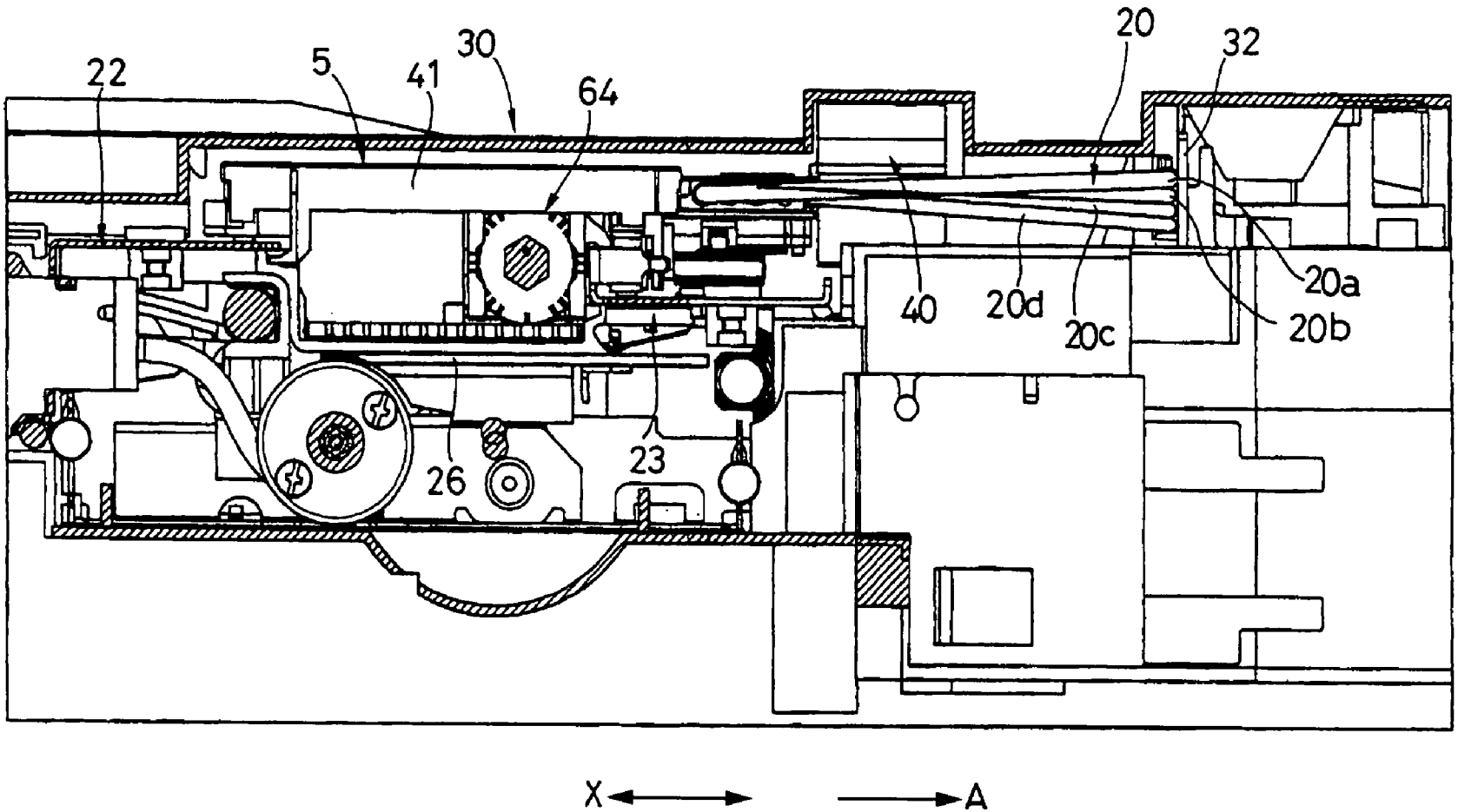
FIG. 7 is an enlarged side sectional view taken along line VII-VII of FIG. 3.
Figure 8:
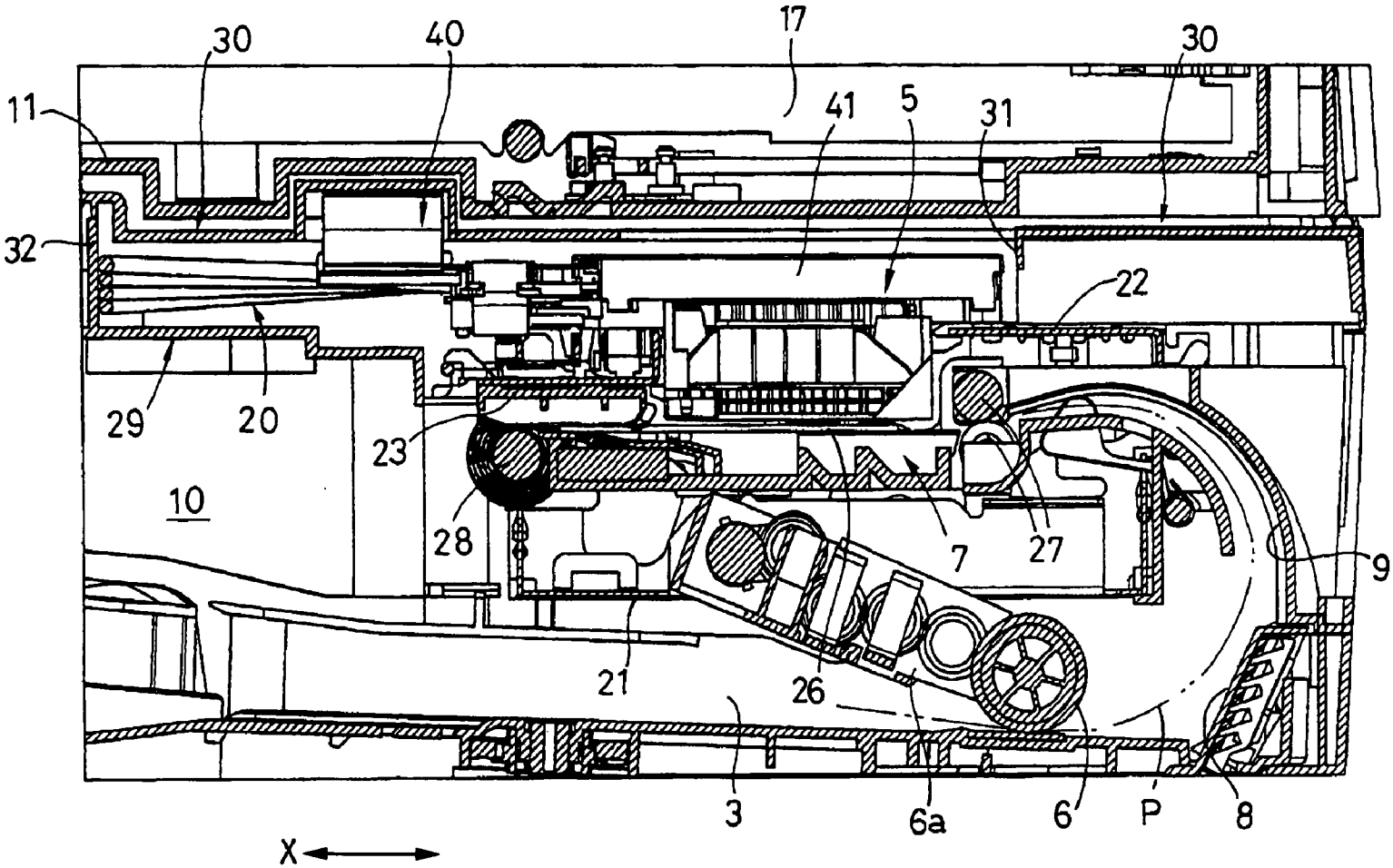
FIG. 8 is an enlarged side sectional view taken along line VIII-VIII of FIG. 3.

The inks are supplied from the respective ink cartridges 19 (individually denoted by 19*a* to 19*d*) to the ink-jet recording head 4 through plural (four in this embodiment) ink supply tubes (ink tubes) 20 (individually denoted by 20*a* to 20*d*, see FIG. 7). Incidentally, in the case where ink colors more than four colors are used (six colors to eight colors, etc.), the structure has only to be modified such that the ink cartridges the number of which corresponds to the number of the ink colors can be housed in the ink storage part 15, and the number of the ink supply tubes 20 are also increased according to the number of the ink cartridges.

As shown in FIGS. 3 to 6, the recording part 7 includes laterally long plate-shaped guide members 22 and 23 which are supported by pair of right and left side plates 21*a* of a main frame 21 and extend in the Y-axis direction (main scanning direction), a carriage 5 which extends over both of the guide members 22 and 23, is slidably supported (mounted) and is constructed to be capable of reciprocating, a timing belt 24 which is disposed on and in parallel to an upper surface of the guide member 23 disposed at the downstream side in the sheet transporting direction (direction of an arrow A) in order to reciprocate the carriage 5 on which the recording head 4 is mounted, a CR (carriage) motor 25 (although it is a DC motor in this embodiment, it may be another motor such as a stepping motor) to drive the timing belt 24, a plate-shaped platen 26 to support the transported sheet P at the lower surface side of the recording head 4, an encoder strip 47 which is disposed to extend in the main scanning direction and is for detecting the Y-axis direction (main scanning direction) position of the carriage 5, and the like. The band-shaped encoder strip 47 is disposed such that a check surface (formation surface of slits disposed at regular intervals in the Y-axis direction) extends in the vertical direction.

Besides, a pair of registration rollers 27 are disposed at both sides of the platen 26 and at the upstream side in the transporting direction, and the sheet P is fed to the lower surface of the recording head 4. A spur (not shown) coming in contact with the upper surface of the sheet P and a paper discharge roller 28 at the lower surface side are disposed at the downstream side of the platen 26, and the recorded sheet P is transported to the paper discharge part 10.

Figure 5:
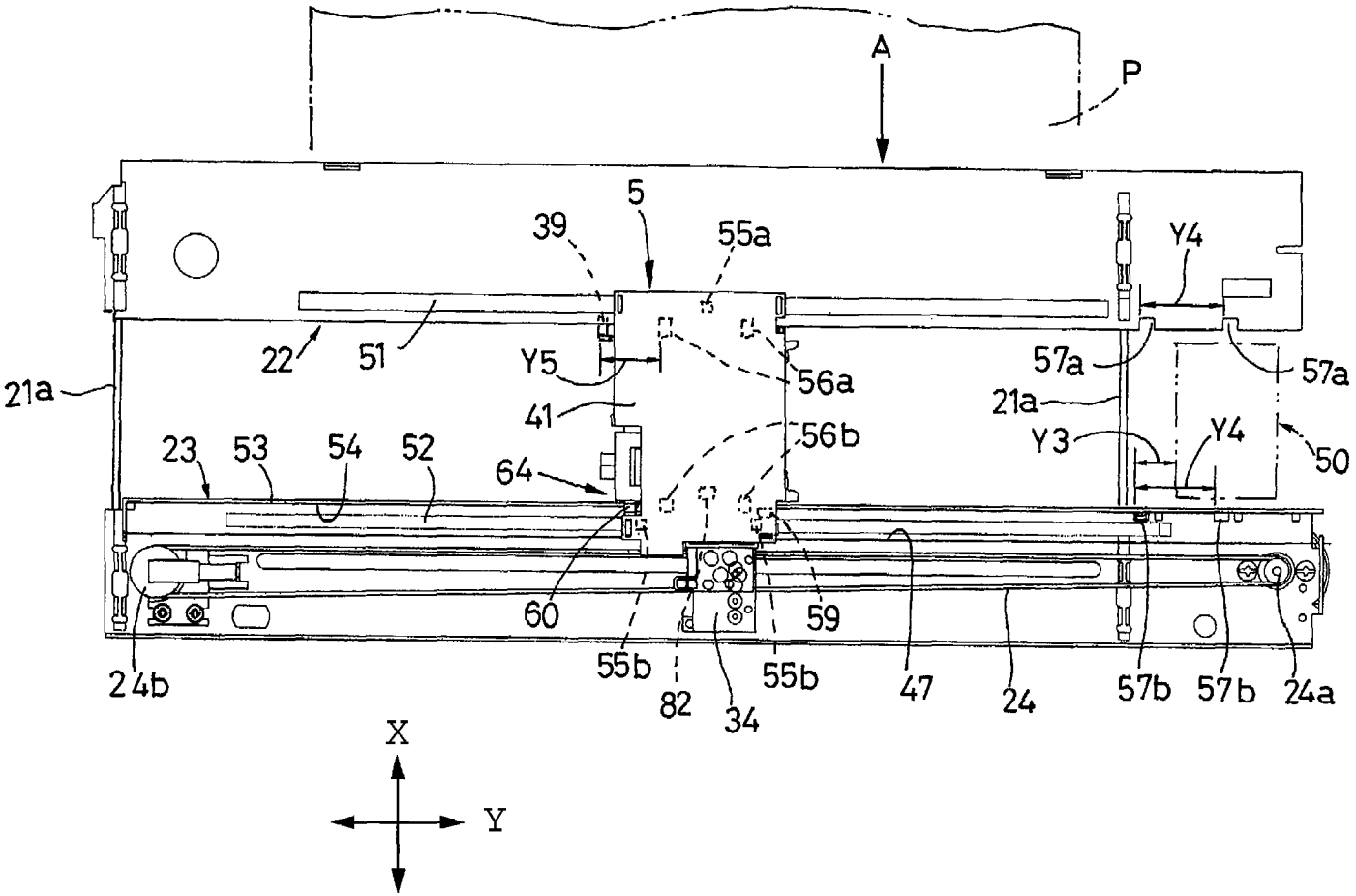
FIG. 5 is a plan view of a carriage and a pair of guide members.
Figure 6:
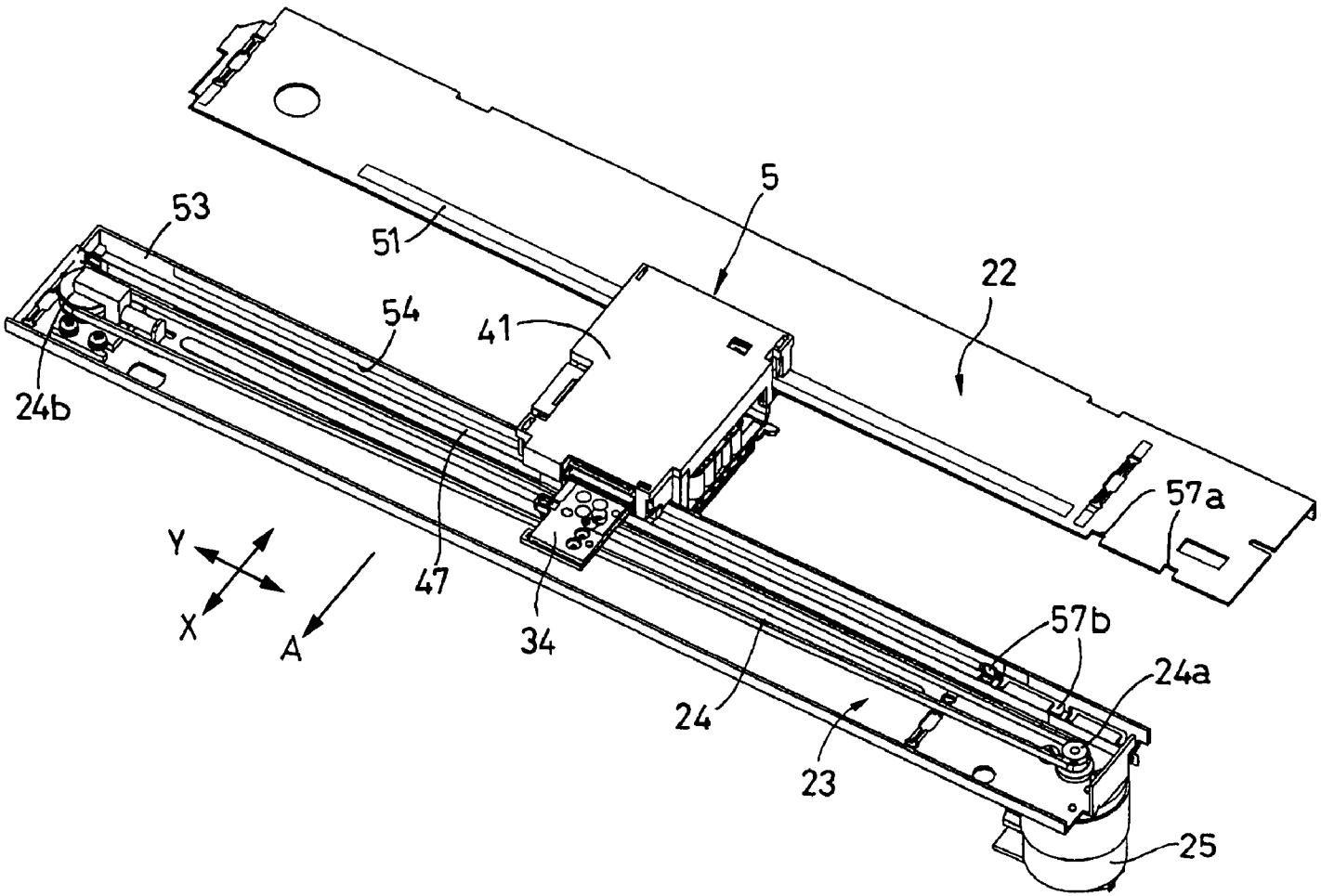
FIG. 6 is a perspective view of the carriage and the pair of guide members.

Besides, at the outside relative to the width (short side of the sheet P) of the sheet P to be transported, an ink receiving part (not shown) is disposed at one end side (in the embodiment, a part near the left side plate 21*a* in FIG. 3), and a maintenance unit 50 is disposed at the other end side (a part near the right side plate 21*a* in FIGS. 3 and 5). By this, the recording head 4 periodically performs an ink discharge to prevent clogging of a nozzle at a flashing position provided in the ink receiving part during a recording operation, and ink is received by the ink receiving part. In the portion of the maintenance unit 50, the carriage 5 is at a standby position, and cleaning of the nozzle surface of the recording head 4 is performed, and further, ink is selectively sucked for each color, and a recovery processing for removing bubbles in a not-shown buffer tank on the recording head 4 is performed.

A partition plate (lower cover body) 29 is disposed which covers an upper part of the discharge part 10 between the lower surface of the guide member 23 at the downstream side in the sheet transporting direction and the paper discharge port 10*a* at the front end of the recording apparatus main body 2. Further, an upper cover body 30 is disposed above this partition plate (lower cover body) 29 to be spaced apart therefrom by a suitable distance and to cover the carriage 5 and an upper part of its reciprocal movement passage. Incidentally, a rectangular window hole 31 through which the reciprocal movement passage of the carriage 5 can be seen from above is provided at the halfway part of the upper cover body 30 (see FIG. 2). In the case where the sheet P causes a paper jam in the recording part 7, the user swings the image reading device 12 from the recording apparatus main body 2 and can remove the sheet P through this window hole 31. In this case, since the ink supply tube 20 is not routed on the platen 26, the removal of the sheet P becomes easy.

The guide member 22 at the upstream side in the sheet transporting direction and the guide member 23 at the downstream side are substantially in the horizontal state, and first sliding surfaces 51 and 52 parallel to the lower surface (head surface on which nozzles are formed) of the recording head 4 in the carriage 5 are formed on the upper surfaces of both of the guide members 22 and 23 at the side close to the arrangement of the carriage 5. Besides, a second sliding surface 54 directed to the downstream side in the sheet transportation is formed on an almost perpendicular (vertical) guide piece 53 obtained by bending the upstream side, in the sheet transporting direction, of the downstream side guide member 23 (see FIGS. 5 and 6).

The carriage 5 includes first sliding convex parts 55*a* and 55*b* which protrude from its lower surface side and come in contact with the first sliding surfaces 51 and 52 of the guide members 22 and 23, and plural coming-out preventing pawls 56*a* and 56*b* disposed to hold the first and second guide members 22 and 23 in cooperation with the first sliding convex parts 55*a* and 55*b*.

In this embodiment, the one first sliding convex part 55*a* coming in contact with the first sliding surface 51 of the first guide member 22 is disposed almost at the center of the carriage 5 in the lateral direction (main scanning direction). The two first sliding convex parts 55*b* coming in contact with the first sliding surface 52 of the second guide member 23 and disposed to be spaced apart from each other by a suitable distance in the lateral direction (main scanning direction), and the two right and left coming-out preventing pawls 56*a* and 56*b* opposite to the lower surface of each of the first and second guide members 22 and 23 are respectively provided at the sides close to the right and left side pieces of the carriage 5 when viewed on a plane (see FIGS. 5, 9 and 10).

The three first sliding convex parts 55*a*, 55*b* and 55*b* are disposed at the respective apexes of a triangle (isosceles triangle is preferable) of the carriage 5 when viewed on a plane, so that the carriage 5 is stably supported relative to the first and second guide members 22 and 23. In order to lightly slide the first sliding convex parts 55*a* and 55*b* while receiving the weight of the carriage 5 against both of the guide members 22 and 23, plural concave recesses 58 long in the X-axis direction and for holding lubricating grease are formed on the lower surfaces (support surfaces or sliding surfaces) of the first sliding convex parts 55*a* and 55*b* in the main scanning direction (Y-axis direction) at suitable intervals (see FIG. 9).

On the other hand, as shown in FIG. 5, plural (two at each of the right and left) notch parts 57*a* and 57*b* are formed in the first guide member 22 and the second guide member 23 at positions outside the recording area relative to the sheet P in the main scanning direction (Y-axis direction). The positions are close to the maintenance unit 50 and are specified positions deviated by a distance Y3. By this, an operation position where the carriage 5 is detached from the guide members 22 and 23 can be made close to a standby position of the carriage 5, and a movement distance of the carriage 5 can be decreased.

Figure 10:
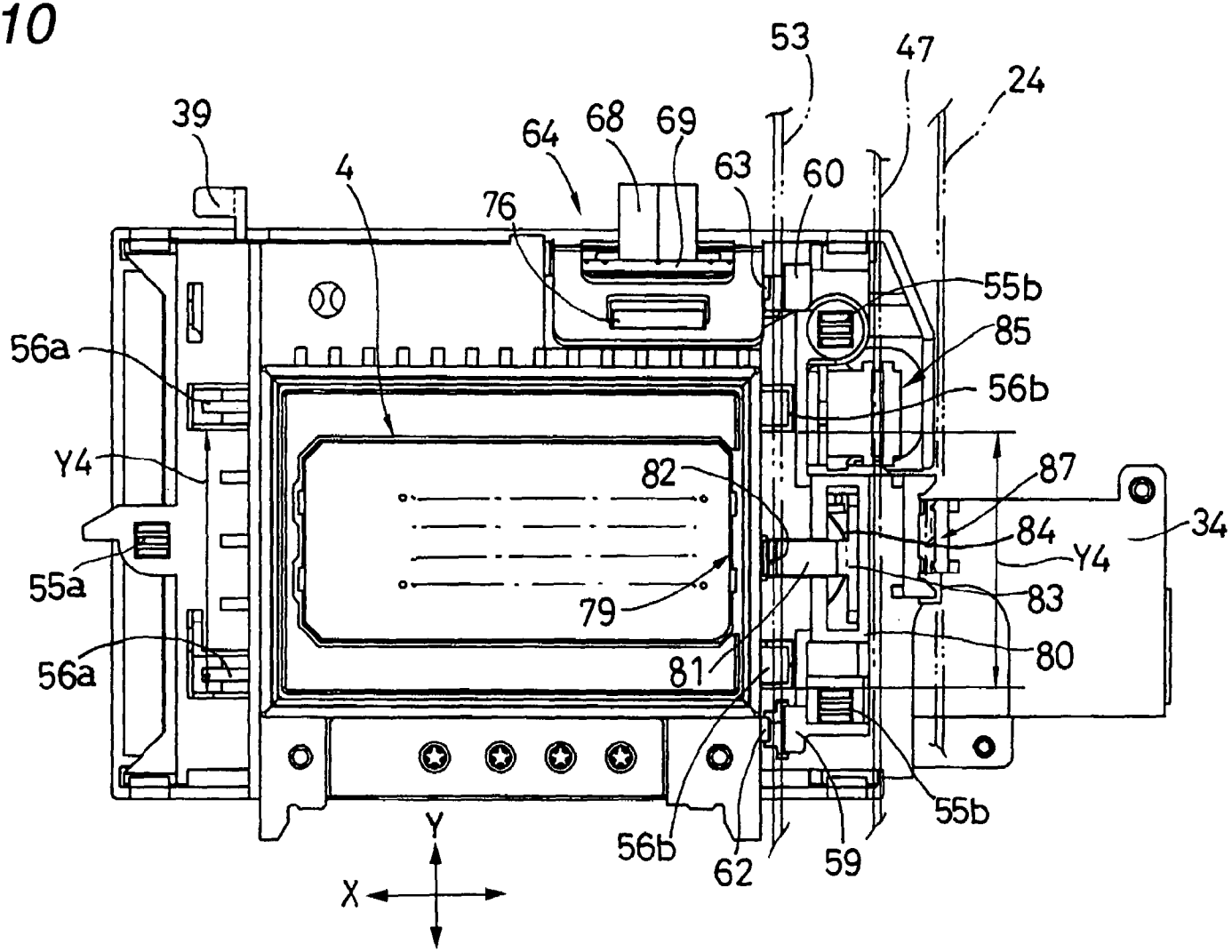
FIG. 10 is a bottom view of the carriage.
Figure 11:
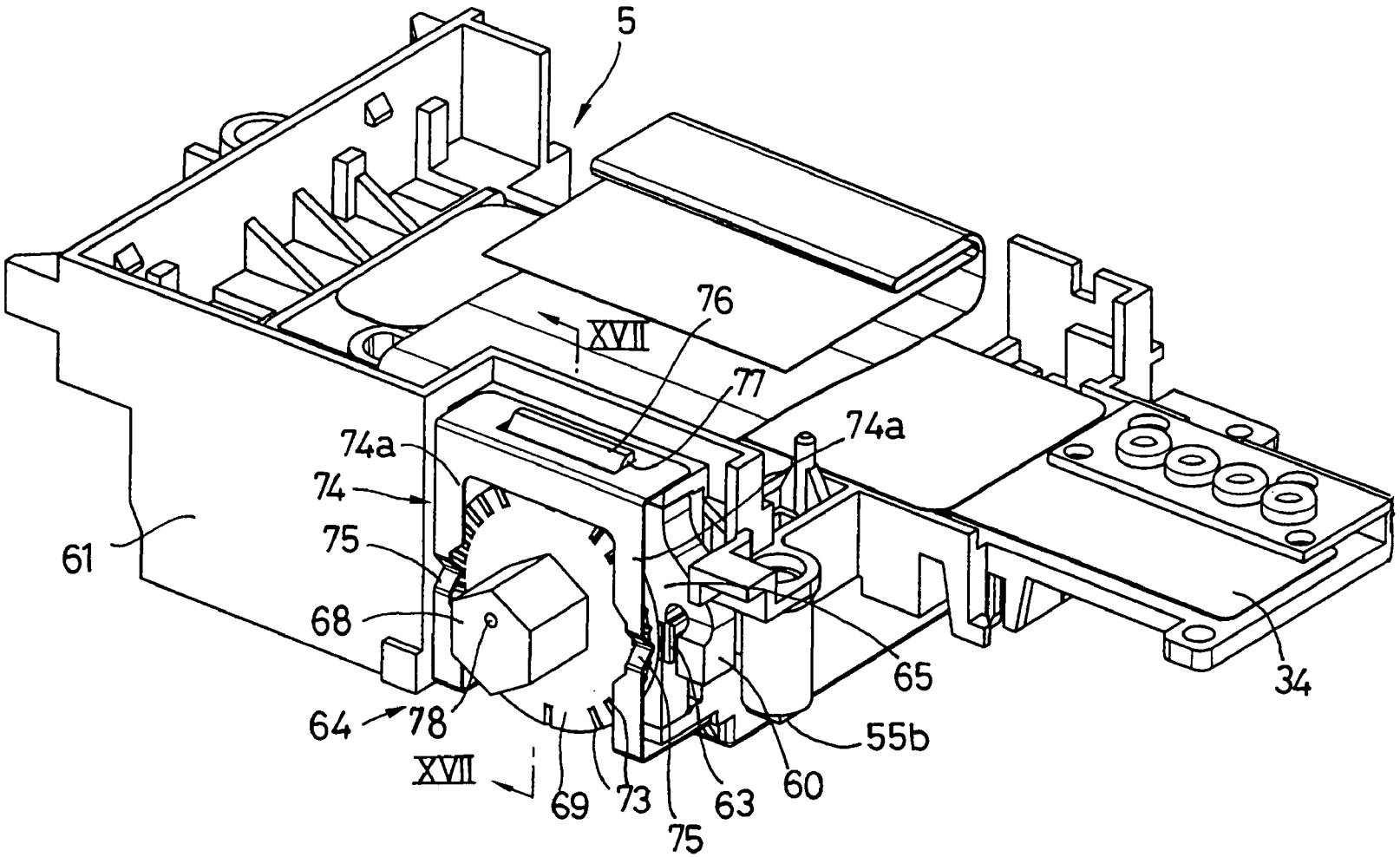
FIG. 11 is a perspective view of the carriage in a state where a lid cover body is removed.
Figure 12:
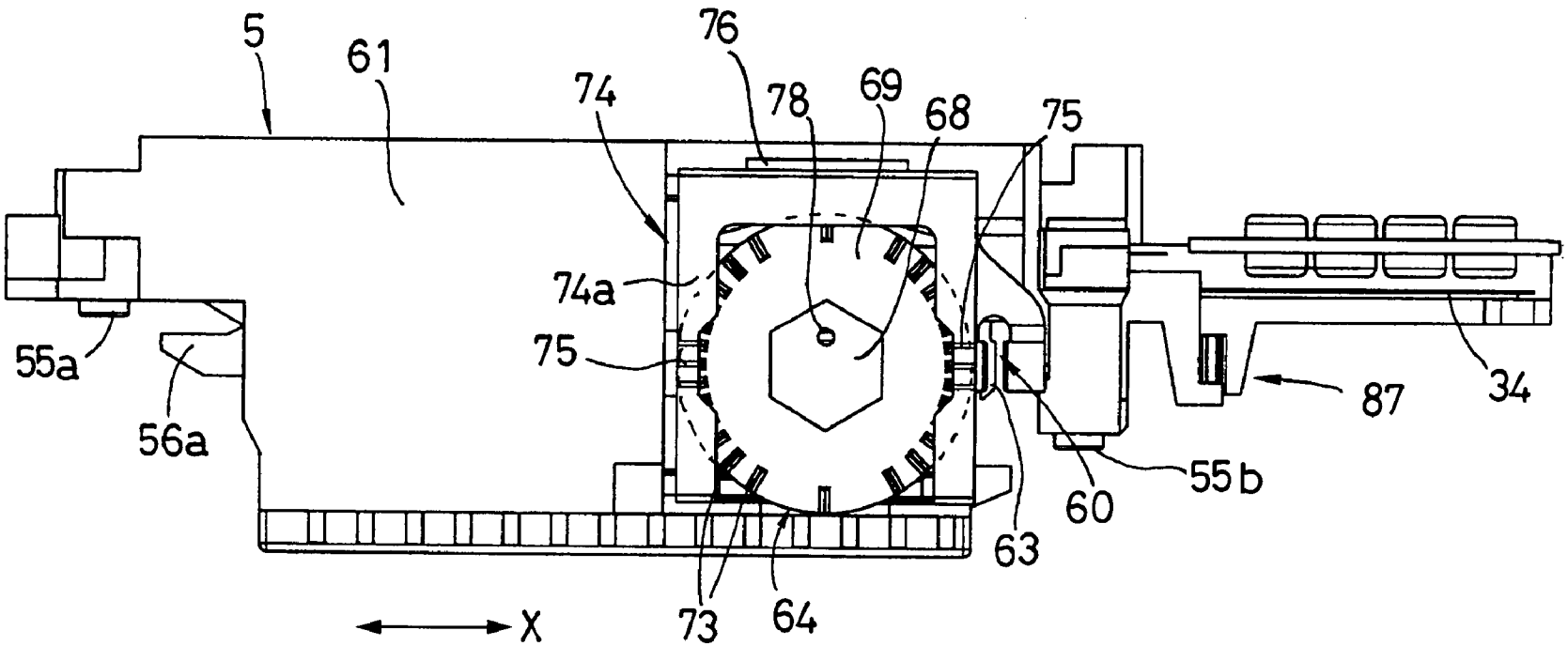
FIG. 12 is a side view of the carriage in the state where the lid cover body is removed.

A distance Y4 between the two notch parts 57*a* of the first guide member 22 and a distance Y4 between the two notch parts 57*b* of the second guide member 23 are respectively set to be equal to arrangement intervals between the two right and left coming-out preventing pawls 56*a* and 56*b* (see FIGS. 5 and 10).

The notch part 57*a* of the first guide member 22 is formed such that the downstream side edge of the first guide member 22 is opened and its shape is substantially rectangular when viewed on a plane. The notch part 57*b* of the second guide member 23 is formed such that a corner part lying astride an upstream side edge of the second guide member 23 and the upward guide piece 53 is opened to have an L-shaped side section (see FIG. 6, FIGS. 14A to 14B, FIGS. 15A to 15B). Besides, a closing member 90 to prevent the coming-out preventing pawl 56*b* from coming out at a normal use time is fitted in the one notch part 57*b*. The closing member 90 is made of, for example, synthetic resin and is formed to have a C-shape side section. As shown in FIG. 18A and FIG. 18B, although the closing member 90 is fitted to the notch part 57*b* of the second guide member 23 from an outer angle side, it is constructed to be removable by the hand of an operator.

The carriage 50 is provided with two second sliding convex parts 59 and 60 which are brought into contact with the second sliding surface 54 of the second guide member 23. The one second sliding convex part 59 is formed integrally with a holder case 61 of the carriage 5 and is disposed such that the vertical guide piece 53 is sandwiched between a holding piece 62 and the second sliding convex part 59. A space between the holding piece 62 and the second sliding convex part 59 is opened in the main scanning direction and downward (see FIGS. 9 and 10).

The other second sliding convex part 60 and a holding piece 63 are provided through a posture adjustment unit 64 to adjust the mount posture of the carriage 5 relative to the vertical guide piece 53 of the second guide member 23, and the second sliding convex part 60 is provided at a position (position spaced much apart from the one second sliding convex part 59) close to the other side of the carriage 5. In this embodiment, as shown in FIG. 7, FIGS. 11 to 13, FIG. 16 and FIG. 17, an adjusting body block 65 integrally provided with the second sliding convex part 60 and the holding piece 63 comes in slide contact with one side surface 61*a* of the holder case 61, is supported by an upper and a lower guide blocks 66*a* and 66*b* provided to protrude at an upper and a lower parts of the one side surface 61*a* of the holder case 61, and is disposed to be slidable in the X-axis direction (see FIG. 17). Besides, a pair of contact surfaces 67*a* and 67*b* opposite to each other are formed in a space of an inner diameter part of the adjusting body block 65. An eccentric round shaft 70 is formed integrally with the back surface of a dial plate 69 having an adjustment knob 68 on its surface, and a shaft hole 72 in which a round spindle 71 protruding from the one side surface 61*a* of the holder case 61 is fitted is formed in the eccentric round shaft 70.

When the eccentric round shaft 70 of the dial plate 69 is fitted over the round spindle 71, the outer peripheral surface (diameter part) of the eccentric round shaft 70 is always in contact with the pair of contact surfaces 67*a* and 67*b*. Concave grooves (notch grooves) 73 used also as graduations are formed, in the circumstantial direction and at suitable intervals, in the portion of the surface of the dial plate 69 close to the outer periphery. The center part of a plate spring body 74 having a C-shaped section and covering the surface side of the dial plate 69 is cut out, and the adjustment knob 68 and the concave grooves (notch grooves) 73 can be exposed. A press part 75 which can be engaged/disengaged with/from the concave groove (notch groove) 73, presses it, and has a lateral V-shaped section, is formed by bending at a halfway part, in the vertical direction, of each of a pair of elastic pieces 74*a* of the plate spring body 74 (see FIGS. 11 and 17). Attachment holes 77 engaged with engagement pawls 76 provided to protrude from the outer surfaces of the upper and lower guide blocks 66*a* and 66*b* of the holder case 61 are formed to penetrate an upper and a lower attachment pieces 74*b* of the plate spring body 74 (see FIG. 17). The adjusting body block 65 is moved in the X-axis direction according to the adjustment knob 68 and the rotation position of the dial plate 69, the protrusion amount of the second sliding convex part 60 relative to the guide piece 53 can be adjusted, and the posture of the carriage 5 when viewed on a plane can be adjusted around the place where the sliding surface of the one first sliding convex part 59 is in contact with the guide piece 53.

Incidentally, the hole 78 (see FIGS. 11, 12 and 16) provided in the surface of the adjustment knob 68 is a tool set hole for setting such a state that the rotation position of the dial plate 69, and the position of the adjusting body block 65 in the X-axis direction is located at a reference position (the reference position is such that a nozzle line of the recording head 4 is disposed to be orthogonal to the vertical guide piece 53 of the second guide member 23).

Figure 9:
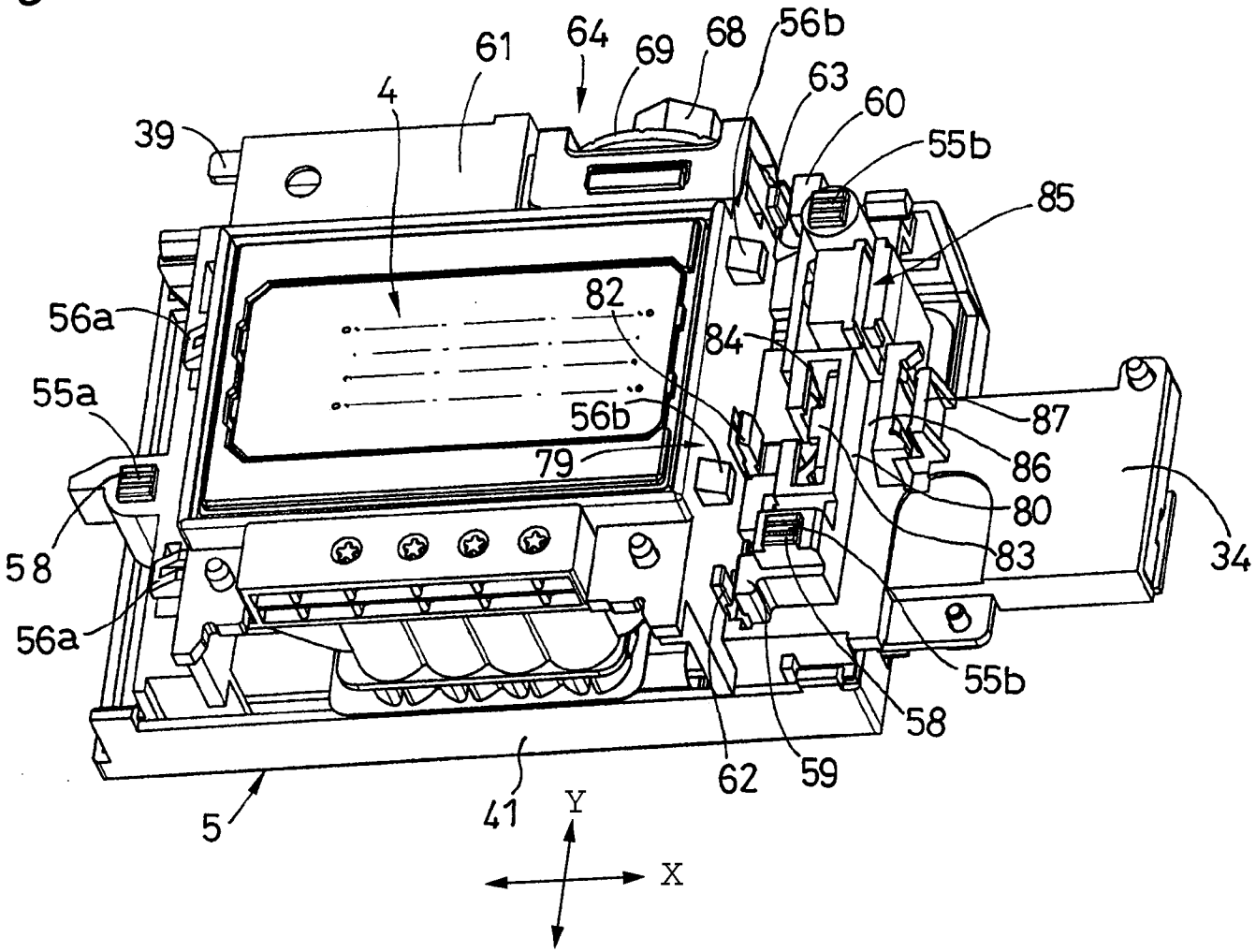
FIG. 9 is a perspective view showing a lower side of the carriage.
Figure 19:
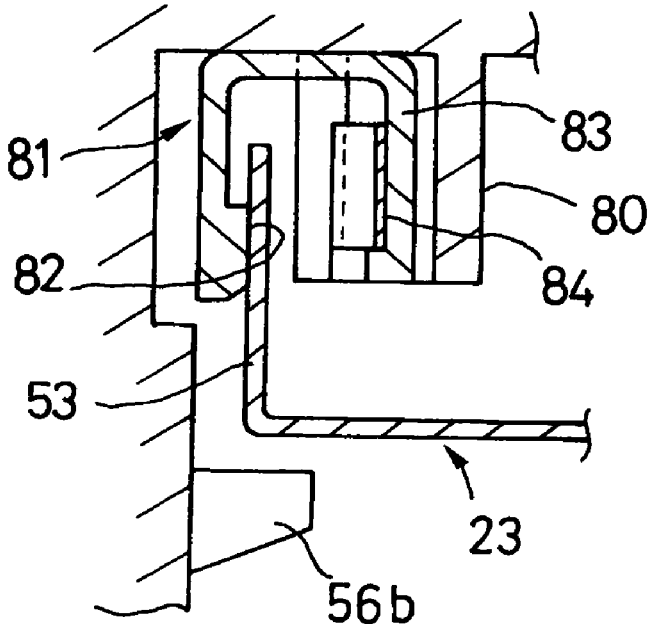
FIG. 19 is a sectional view of a press unit to a vertical guide piece of a second guide member.

Besides, an urging unit 79 to always press and urge the vertical guide piece 53 of the second guide member toward the sliding surfaces of the pair of second sliding convex parts 59 and 60 is provided between the pair of second sliding convex parts 59 and 60 in the Y-axis direction. In this embodiment, as shown in FIGS. 9, 10 and 19, a support part 80 having a C shape when viewed on a plane is integrally formed downward at the lower surface side of the holder case 61. A spring receiving part 83 of a press body 81 having a third sliding convex part 82 at one side and having a C-shaped side section is disposed in the inside of the support part 80 to be movable in the X-axis direction. Both ends of a plate spring 84 as an elastic member having a bow shape when viewed on a plane is supported by the inner surface of the support part 80, and the center part of the plate spring 84 presses the spring receiving part 83, and by this, the third sliding convex part 82 elastically urges the guide piece 53 toward the sliding surface direction of the pair of second sliding convex parts 59 and 60 and always enables slide contact.

Each of the sliding surfaces of the first sliding convex parts 55*a* and 55*b*, the second sliding convex parts 59 and 60, and the third sliding convex part 82 is formed into a convex curved shape in the main scanning direction (Y-axis direction). That is, these sliding surfaces come in line contact with the first sliding surfaces 51 and 52 and the second sliding surface 54 in the X-axis direction.

The carriage 5 is provided with a light transmission sensor (photo-coupler) 85 for detecting its position. A guide groove 86 which is opened downward and through which the encoder strip 47 can pass is formed in the vicinity of a root part between the holder case 61 of the carriage 5 and an after-mentioned coupling piece 34. The photo-coupler 85 is disposed at a position adjacent to the guide groove 86 and at both sides of the front and back surfaces of the encoder strip 47 (see FIGS. 9 and 13, etc.). The photo-coupler 85 is also opened in the Y-axis direction and downward.

Further, an attachment part 87 for coupling and fixing a part of the timing belt 24 is provided in the vicinity of the root part between the holder case 61 of the carriage 5 and the coupling piece 34. Since the attachment part 87 is provided at a position slightly higher than height positions of winding parts (pulley parts 24*a* and 24*b*) of both ends of the timing belt 24, by the tensile force of the timing belt 24, the carriage 5 always receives a force to press it toward the upper surface of the downstream side guide member 23.

A lid cover body 41 to cover the upper surface of the holder case 61 is detachably attached to the upper surface of the carriage 5. A control board (not shown) which receives a signal from an after-mentioned flexible flat cable 40 and outputs a specified drive signal to the recording head 4 is disposed on the lower surface side of the lid cover body 41. The detachment/attachment of the lid cover body 41 is necessary for maintenance such as exchange of the control board. A blocking pawl 39 to face the lower surface of the upstream side guide member 22 is formed integrally downward in the lid cover body 41 (see FIGS. 5, 9 and 10). The blocking pawl 39 is disposed substantially at the same height as the coming-out preventing pawl 56*a*, and is located at a position spaced apart from the one coming-out preventing pawl 56*a* by Y5 (<Y4, see FIG. 5) in the main scanning direction.

Next, a detailed description will be given to an arrangement structure of the ink supply tubes 20 which always couple the respective ink cartridges 19 contained in the ink storage part 15 to the recording head 4 of the recording part 7 and have flexibility.

In this embodiment, the respective ink supply tubes 20*a* to 20*d* are tube bodies independent of each other, and the lengths of all the ink supply tubes 20*b* to 20*d* are made equal to each other and are used.

As shown in FIGS. 3 and 4, root parts of the plural (four in this embodiment) ink supply tubes 20 are bundled at a portion of one end part 15*a* of the ink storage part 15, and are extended on the upper surface of the lower cover body 29 from its one side end part (right end part in FIG. 3) to the other end part (left end part in FIG. 3) in the Y-axis direction. At this time, the root parts of all the ink supply tubes 20*a* to 20*d* are arranged in one lateral line along the upper surface of the substantially horizontal lower cover body 29. At least a part (halfway part etc.) of this ink supply tube 20 is supported by the upper surface of the lower cover body 29.

Next, all the ink supply tubes 20*a* to 20*d* are twisted such that their halfway parts extend along one longitudinal surface (almost vertical surface) of a laterally long longitudinal partition plate 32 of the lower cover body 29, and the halfway parts of all the ink supply tubes 20*a* to 20*d* are arranged in one longitudinal line and are fixed (held or sandwiched) between the longitudinal partition plate and a vertical plate-shaped fixing body 33 made of synthetic resin and fixed by screws or the like to face the one longitudinal surface of the longitudinal partition plate 32. A portion where all the ink supply tubes 20*a* to 20*d* are fixed (held) by the fixing body 33 and the one longitudinal surface of the longitudinal partition plate 32 becomes an intermediate fixing part. Incidentally, the intermediate fixing part may has such a structure that the halfway parts of all the ink supply tubes 20*a* to 20*d* are arranged in one vertical line and are fixed (held or sandwiched) by, for example, a downward U-shaped or an upward U-shaped fixing body (not shown).

The carriage 5 is provided with the coupling piece 34 extending substantially horizontally in the sheet transporting downstream direction (direction of the arrow A), and tip parts of all the ink supply tubes 20*a* to 20*d* are connected in an arrangement of one substantially horizontal lateral line to a coupling part (connecting part) 35 provided at the left end of the coupling piece 34 in FIG. 3. The directions of all the ink supply tubes 20*a* to 20*d* are changed from left to right between the place of the intermediate fixing part (fixing body 33) and the coupling part (connecting part) 35, and the ink supply tubes are twisted such that the phase of the lines (arrangement) of all the ink supply tubes 20*a* to 20*d* varies from the substantially vertical direction at the intermediate fixing part (fixing body 33) side to the substantially horizontal direction at the coupling part (connecting part) 35 side. In other words, the halfway parts of the four ink supply tubes 20*a* to 20*d* are curved and arranged so that the direction is changed by 180 degrees when viewed on a plane between the movement passage of the carriage 5 and the intermediate fixing part (fixing body 33). In this curved halfway part, the ink supply tubes are routed such that the phase of the arrangement directions of the four ink supply tubes 20*a* to 20*d* extending toward the intermediate fixing part side is made different from the phase of the arrangement directions of the four ink supply tubes 20*a* to 20*d* extending toward the coupling part 35 side of the ink supply tube 20*a* to 20*d* in the carriage 5. It is of course that all the ink supply tubes 20*a* to 20*d* are independently separate from each other between the place of the intermediate fixing part (fixing body 33) and the coupling part (connecting part) 35.

As stated above, in the halfway part (from the place of the intermediate fixing part (fixing body 33) to the coupling part (connecting part) 35, or non-bundled or non-restricted area), curving (inverting) is performed so that the direction of extension toward the intermediate fixing part (fixing body 33) side is different from the direction of extension toward the coupling part 35 side of the carriage 5 by 180 degrees. Further, in the curved halfway part, twisting is performed so that the phase of the arrangement directions of the ink supply tubes 20*a* to 20*d* extending toward the intermediate fixing part (fixing body 33) side is different from the phase of the arrangement directions of the ink supply tubes 20*a* to 20*d* extending toward the coupling part 35 side of the carriage 5. Then, although the respective ink supply tubes 20*a* to 20*d* are curved independently of each other, all the ink supply tubes 20*a* to 20*d* become easy to bundle. Especially, in the case where the arrangement of the ink supply tubes 20*a* to 20*d* at the intermediate fixing part (fixing body 33) side is in the longitudinal direction (vertical direction) and the arrangement at the coupling part 35 side is in the horizontal direction, the arrangement of the ink supply tubes 20*a* to 20*d* during the movement becomes less disordered (disturbed) in the vertical direction at the curved halfway part, and the posture of the ink supply tubes 20*a* to 20*d* during the movement becomes stable.

As a result, the space height of the area (movable area, or non-bundled or non-restricted area) through which the ink supply tubes 20*a* to 20*d* pass in the case where the carriage 5 reciprocates in the Y-axis direction (main scanning direction) can be made small, and the height of the recording apparatus main body 2 can be made compact. Besides, when the arrangement of the ink supply tubes 20*a* to 20*d* at the coupling part 35 side is in the horizontal direction, interference with other tightly-packed parts at the carriage 5 side can be made less, and the height size at the carriage 5 portion can be made low. Further, even if all the ink supply tubes 20*a* to 20*d* are independent of each other, since the posture during the movement becomes stable, it becomes unnecessary to separately provide a tube bundling device, the assembling quality is improved, and the cost can be reduced.

This embodiment will be described in more detail. The inner diameter of the ink supply tube 20*a* to supply black (BK) ink is 1.6 mm, and its outer diameter is 2.4 mm. The inner diameter of each of the three ink supply tubes of the ink supply tube 20*b* to supply cyan (C) ink, the ink supply tube 20*c* to supply magenta (M) ink and the ink supply tube 20*d* to supply yellow (Y) ink is 1.2 mm and the outer diameter is 2.0 mm. Accordingly, the flexural rigidity (geometrical moment of inertia) relating to the axial line of the ink supply tube 20*a* is 1.91 times as high as the flexural rigidity of each of the ink supply tubes 20*b* to 20*d* for color inks of cyan and the like. In this embodiment, the inner diameter of the ink supply tube 20*a* for black (BK) ink is made large as compared with the case of the other color ink. This is because, in order to make the recording speed in the case of monochrome recording higher than that of color recording, the number of nozzles for black (BK) ink in the recording head 4 is made more than the number of nozzles for the other color ink (substantially, the nozzle line is doubled), so that the ink supply amount per unit time must be increased.

In the portion of the one end part 15*a* of the ink storage part 15, the ink supply tube 20*a* for black (BK) ink is disposed at the most upstream side in the sheet transportation, and next, at the downstream side thereof, the ink supply tube 20*b* for cyan (C) ink, the ink supply tube 20*c* for magenta (M) ink, and the ink supply tube 20*d* for yellow (Y) ink are arranged in sequence. In the embodiment of FIGS. 3 and 7, at the place of the intermediate fixing part (fixing body 33), the ink supply tubes 20*a*, 20*b*, 20*c* and 20*d* are arranged in sequence from above in the vertical direction.

Accordingly, at the curved halfway part, the radius R of curvature of the ink supply tube 20*a* for black (BK) ink is largest, and the radius of curvature becomes small in the sequence of the ink supply tube 20*b* for cyan (C) ink, the ink supply tube 20*c* for magenta (M) ink, and the ink supply tube 20*d* for yellow (Y) ink.

As stated above, the radius R of curvature of the ink supply tube for black (BK) ink with the large flexural rigidity is made larger than that of each of the ink supply tubes 20*b* to 20*d* having low flexural rigidity, so that with respect to bending, the load of the ink supply tube 20*a* for black (BK) ink due to bending deformation can be decreased, and the durabilities of all the ink supply tubes 20*a* to 20*d* can be made substantially uniform.

At the intermediate fixing part by the fixing body 33, when setting is made such that the arrangement height position of the ink supply tube 20*a* having high flexural rigidity becomes a position higher than the horizontal height position passing (connecting) the center lines of all the ink supply tubes 20*a* to 20*d* at the position of the coupling part 35, an acting force is exerted such that the ink supply tube 20*a* is routed downward toward the coupling part 35. In the case where the carriage 5 is mounted from above on the guide members 22 and 23 at the sheet transportation upstream side and the downstream side, it is possible to certainly prevent the carriage 5 from floating above both the guide members 22 and 23 by the downward acting force, and the reciprocal movement in the main scanning direction (Y direction) can be stabilized.

In this embodiment, the flexible flat cable 40 for transmitting an instruction signal to discharge an ink droplet selectively from a nozzle of the recording head 4 mounted on the carriage 5 from a not-shown control part provided at the recording apparatus main body 2 side, is disposed in the area (movable area, or non-bundled or non-restricted area) through which the ink supply tubes 20*a* to 20*d* pass in the case where the carriage 5 reciprocates in the Y-axis direction (main scanning direction) and substantially in parallel to the direction in which the ink supply tube 20 extends (see FIGS. 3 and 4).

The convex curved direction of the curved halfway part of the ink supply tube 20 and the convex curved direction of the curved halfway part of the flexible flat cable 40 are set to be opposite to each other with respect to the reciprocal movement direction of the carriage. In other words, the direction in which the ink supply tube 20 extends relative to the coupling part 35 of the carriage 5 is set to be opposite to the direction in which the flexible flat cable 40 extends relative to the carriage 5. Besides, in the space between the upper and the lower cover bodies 30 and 29, curving formation is performed so that inversion in the vertical direction occurs at a halfway part 40*a* of the flexible flat cable 40.

By adopting the structure as stated above, the ink supply tubes 20 and the flexible flat cable 40 can be arranged substantially at the same height (substantially the same horizontal plane), and as a result, the whole image recording apparatus 1 can be made thin.

Figure 13:
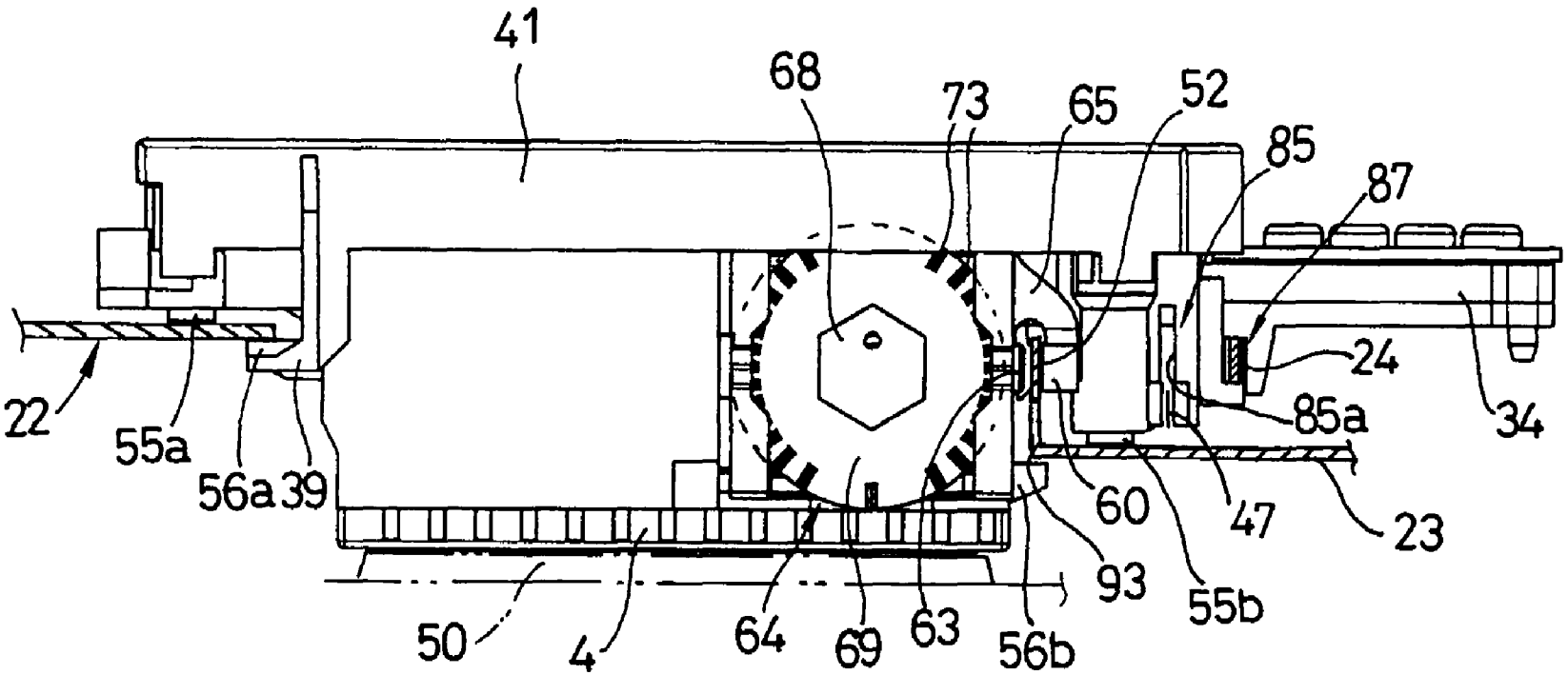
FIG. 13 is a side view of the carriage mounted on first and second guide members.

By the above structure, at the normal recording operation time, as shown in FIG. 13, the sliding surface of the one first sliding convex part 55*a* of the carriage 5 comes in slide contact with the first sliding surface 51 of the upstream side first guide member 22, and the other two first sliding convex parts 55*b* come in slide contact with the first sliding surface 52 of the second guide member 23. The vertical guide piece 53 of the second guide member 23 is sandwiched between the right and left second sliding convex parts 59 and 60 and the corresponding holding pieces 62 and 63. The third sliding convex part 82 presses the upstream side surface of the guide piece 53 by the urging force of the plate spring 84, so that the right and left second sliding convex parts 59 and 60 come in slide contact with the second sliding surface 54 at the downstream side of the guide piece 53.

In this state, the respective coming-out preventing pawls 56*a* and the blocking pawl 39 are positioned at the lower surface side of the first guide member 22, the respective coming-out preventing pawls 56*b* are positioned at the lower surface side of the downstream side second guide member 23, and the carriage 5 cannot be detached upward from both the guide member 22 and 23. The encoder strip 47 parallel to the guide piece 53 is positioned in the check groove 85*a* of the photo-coupler 85.

The plane on which the carriage 5 is stable with respect to the first sliding surfaces 51 and 52 as the horizontal planes of both the guide members 22 and 23 is determined by the first sliding convex parts 55*a*, 55*b* and 55*b* at the three apex positions of the triangle, and can be made the reference height position of the nozzle plane of the recording head 4 in the carriage 5. The vertical direction guide piece 53 is sandwiched between the right and left second sliding convex parts 59 and 60 and the third sliding convex part 82 therebetween, so that the second sliding surface 54 acts as a reference for the reciprocal movement of not only the carriage 5 but also the recording head 4 in the main scanning direction.

Further, by the posture adjustment unit 64, the nozzle line of the recording head 4 is disposed to be orthogonal to the vertical guide piece 53 of the second guide member 23 and the reference position can be set. Besides, since the guide piece 53 is disposed at a part close to a place where the tip end parts of the ink supply tubes 20 connected to the coupling part 35 of the coupling piece 34 of the carriage 5 are curved, the action to press the second sliding convex parts 59 and 60 of the carriage 5 to the second sliding surface 54 of the guide piece 53 occurs by the reaction force due to the curve of the ink supply tube 20, and the stability of the posture of the carriage 5 at the time of movement can be further improved.

Next, in order to detach the carriage 5 from the first and second guide members 22 and 23 for the operation of exchanging the recording head 4 together with the carriage 5, first, it is necessary to detach the lid cover body 41 from the carriage 5 and both the guide members 22 and 23. For that purpose, the carriage 5 is moved rightward to the vicinity of the maintenance unit 50 in FIG. 5, and the blocking pawl 39 is made to be aligned with the place of the left notch part 57*a* of the first guide member 22. In this state, since the positions of the four coming-out preventing pawls 56*a* and 56*b* are not coincident with the positions of the four notch parts 57*a* and 57*b*, the holder case 61 cannot be detached from both the guide members 22 and 23. Then, the blocking pawl 39 is pulled out upward through the notch part 57*a*, and the lid cover body 41 is detached from the holder case 61. Next, the closing member 90 is removed from the one notch part 57*b*, the carriage 5 is further moved rightward, and the four coming-out preventing pawls 56*a* and 56*b* are stopped at the position where they are aligned with the four notch parts 57*a* and 57*b* (see FIG. 14A).

Figure 14A:
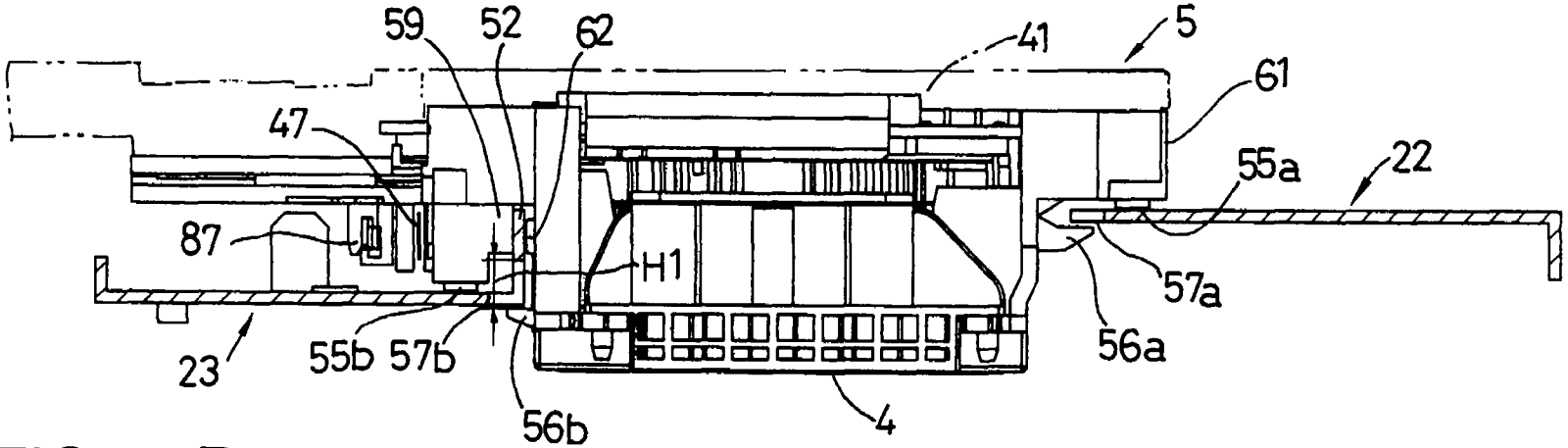
FIG. 14A is a side view of the carriage positioned at a detachment position in a state where the lid cover body is detached.
Figure 14B:
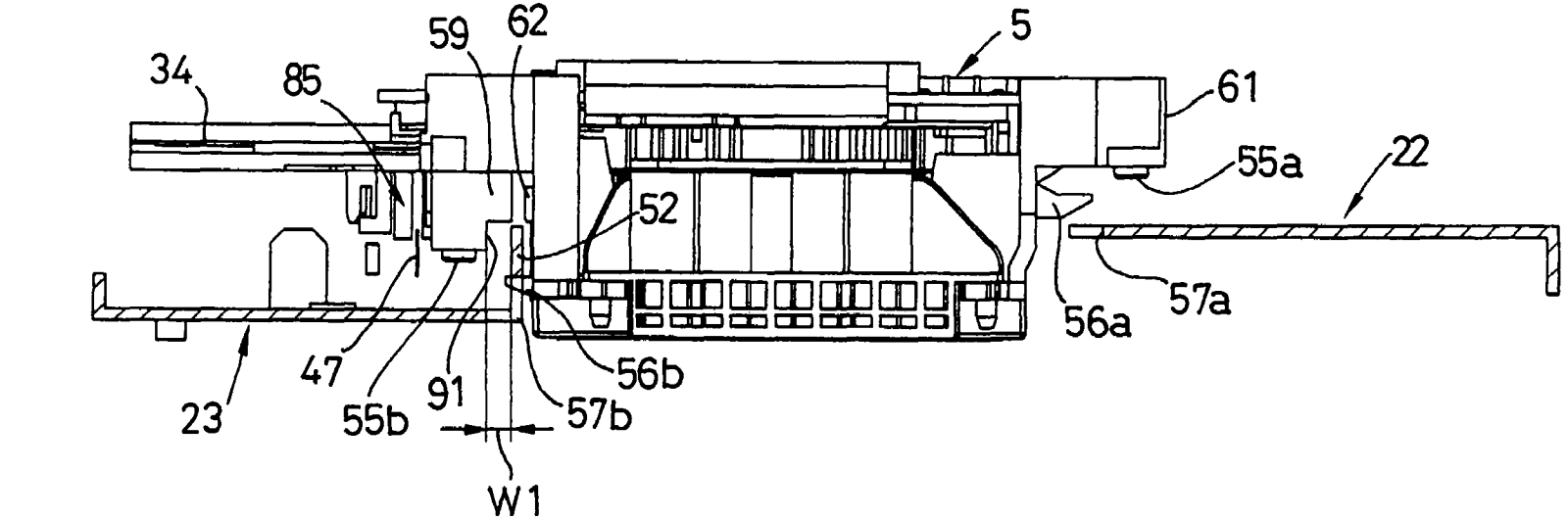
FIG. 14B is an explanatory view in which the carriage is raised by a specified distance.
Figure 15A:
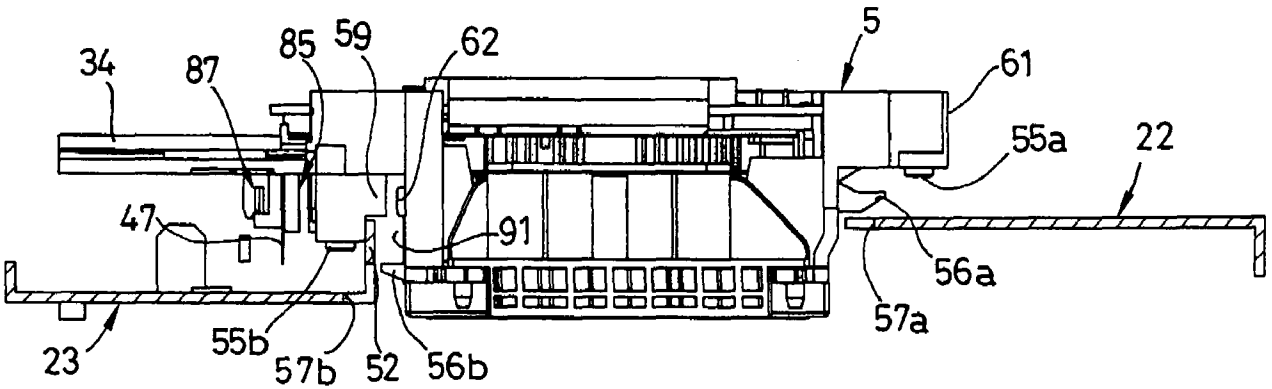
FIG. 15A is an explanatory view showing a state where the carriage is horizontally moved by a specified distance.
Figure 15B:
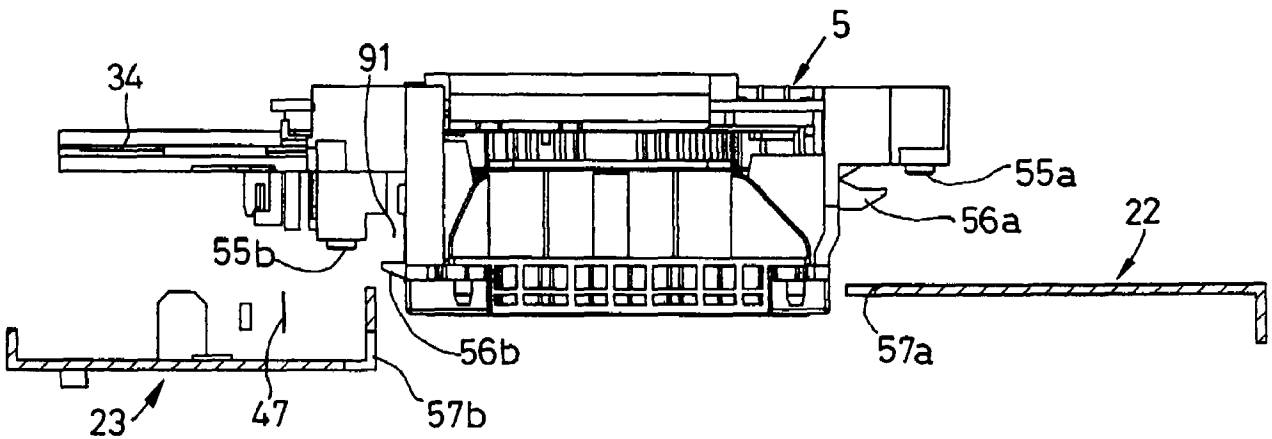
FIG. 15B is an explanatory view showing a state where the carriage is completely separated from the guide members.
Figure 16A:
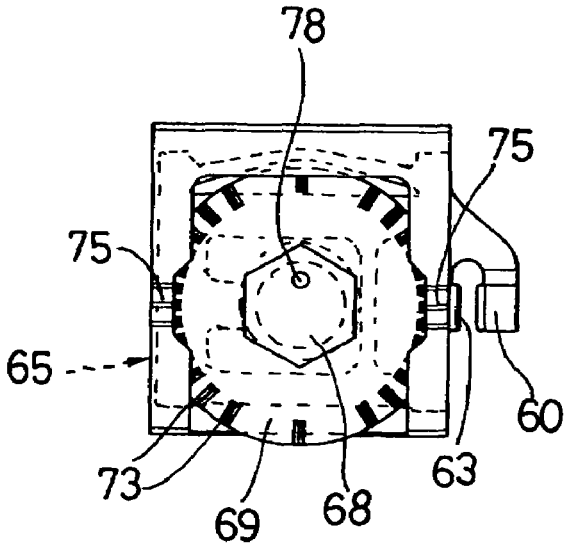
FIG. 16A is a front view of a posture adjustment unit.
Figure 16B:
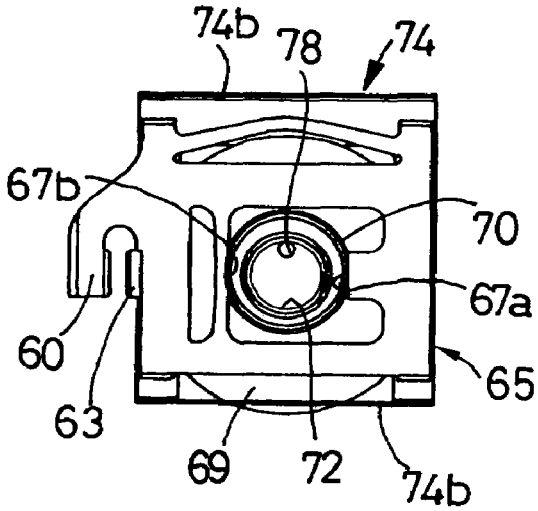
FIG. 16B is a back view showing an adjustment body block.
Figure 17:
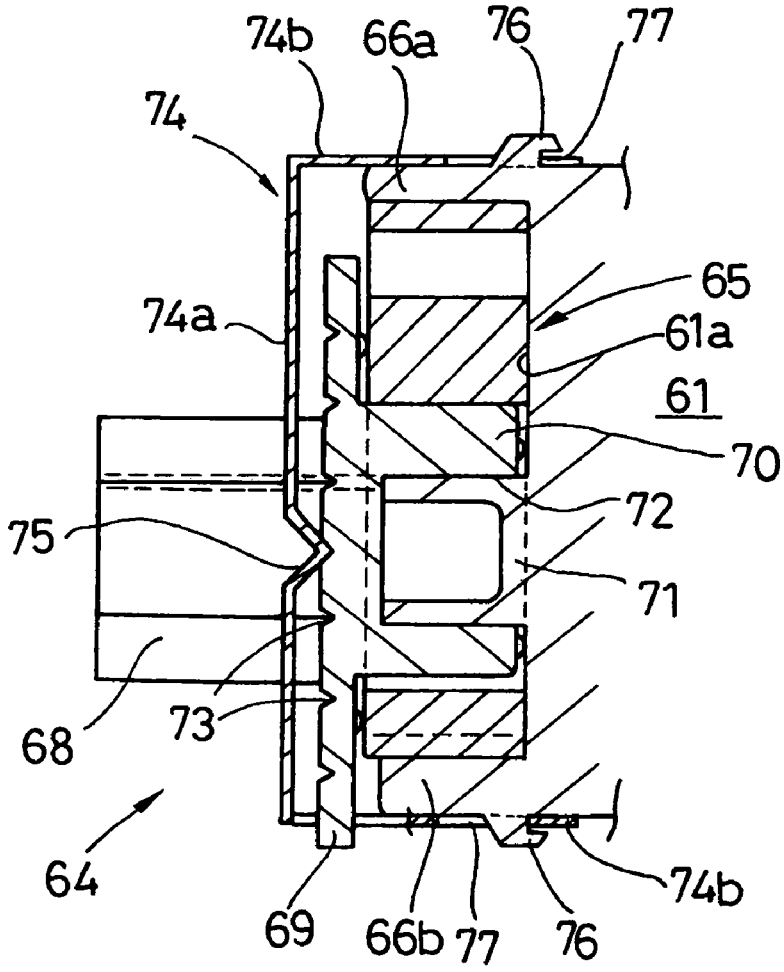
FIG. 17 is an enlarged sectional view taken along line XVII-XVII of FIG. 11.

In this state, first, as shown in FIG. 14B, the carriage 5 is raised substantially in the horizontal state up to the upper edge (height size H1) of the notch part 57*b* of the second guide member 23 at the guide piece 53 side. By this rising movement, the coming-out preventing pawl 56*a* is pulled out (passes) upward through the notch part 57*a* of the first guide member 22, and the carriage rises up to the position where the coming-out preventing pawl 56*b* nearly comes in contact with the upper edge of the notch part 57*b* at the guide piece 53 side. At the same time, the upper edge of the vertical guide piece 53 also comes out of the lower ends of the second sliding convex parts 59 and 60 and the holding pieces 62 and 63. At the same time, the upper edge of the guide piece comes out of the third sliding convex part 82 as well. Similarly, the almost upper edge of the encoder strip 47 comes out of the place of the photo-coupler 85 downward. Next, as shown in FIG. 15A, the whole carriage 5 is substantially horizontally moved toward the second guide member 23 side (downstream side in the transporting direction). The movement distance is slightly larger than a size W1 of the notch part 57*b* to the depth side edge of the second guide member 23. Incidentally, a gap 91 is formed such that at the time of the horizontal movement, the upper edge of the guide piece 53 do not interfere with the lower surfaces of the second sliding convex parts 59 and 60 and the third sliding convex part 82 and the side surface of the first sliding convex part 55*b*. The coming-out preventing pawl 56*b* completely comes out of (passes) the notch part 57*b* of the vertical guide piece 53 by this horizontal movement. Thus, when the whole carriage 5 is raised as it is (see FIG. 15B), the trouble to remove the coming-out preventing pawl 56*b* from the carriage 5 is saved, and the carriage 5 can be easily detached (separated) from the second guide member 23 having the L-shaped side section. Besides, the carriage 5 can be easily detached from both the guide members 22 and 23 without detaching the encoder strip 47 in the vertical state from the second guide member 23. Incidentally, the timing belt 24 can be detached from the attachment part 87 in the middle of the operation or after the operation.

On the other hand, the carriage 5 is made to face the maintenance unit 50, the nozzle surface of the recording head 4 is covered with a cap (not shown) from below, and ink is selectively sucked from the nozzle for each color, or the restoring processing to remove bubbles in a not-shown buffer tank above the recording head 4 is performed. In that case, the carriage 5 is moved to the aligned position with the cap part of the maintenance unit 50 when viewed on a plane. When the cap is raised in this state, the carriage 5 is made not to be detached from both the guide members 22 and 23. As an embodiment for that, in FIG. 5, the carriage 5 is moved rightward by Y3 from the pair of notch parts 57*a* of the first guide member 22 and the pair of notch parts 57*b* of the second guide member 23, and is stopped at the position. When a bent corner part at the place between the second guide member 23 and the vertical guide piece 53 at the transportation direction upstream side is slightly rounded in the side section, there is a fear that the tip end of the coming-out preventing pawl 56*b* passes through the bent corner part upward by the force when the carriage 5 is pressed upward. In order to prevent that, as shown in FIGS. 18A to 18C, an outer edge 93 of a horizontal piece of the second guide member 23 at the transportation direction upstream side is formed to be coincident with the outer surface of the guide piece 53. By this, the rising tip edge of the coming-out preventing pawl 56*b* interferes with the outer edge 93 of the horizontal piece of the second guide member 23 at the transportation direction upstream side, and detachment can be made impossible.

Besides, in the case where the recording head 4 is disposed to deviate rightward or leftward with respect to the barycentric position of the carriage 5 in the Y-axis direction (right and left direction), when the recording head 4 is pressed up from below so that the cap covers the recording head, the moment to rotate the carriage 5 in the right or left direction is exerted thereon. Also at such a state, in order to prevent the carriage 5 from detaching from both the guide members 22 and 23, the pair of coming-out preventing pawls 56*a* and 56*b* are disposed at side parts (positions significantly spaced apart from each other at both sides of the barycentric position of the carriage 5 in the Y-axis direction (right and left direction)) of the carriage 5 in the right and left direction of the recording head 4 when viewed on a plane, so that it is possible to certainly prevent only one side of the carriage 5 from detaching from both the guide members 22 and 23.

When material for formation of at least one of or all of the sliding surfaces of the first sliding convex parts 55*a* and 55*b*, the second sliding convex parts 56*a* and 56*b* and the third sliding convex part 82 is made a material (synthetic resin such as nylon) having a small friction coefficient or wear resistance, after the base parts of these sliding convex parts are primarily molded (injection molded) integrally with the holder case 61 requested to have strength, a material having a small friction coefficient or wear resistance is secondarily molded (outsert molded) for the parts to form the sliding surfaces of the sliding convex parts, so that a product can be easily formed of two kinds of materials to satisfy different design requests.

As described above, in the image recording apparatus 1, one guide member of the first guide member 22 and the second guide member 23 includes a second sliding surface 54 provided to stand substantially orthogonally to the first sliding surface 51, 52, and the carriage 5 includes a second sliding convex part which comes in contact with the second sliding surface and is slidable, and an elastic member to elastically urge a third sliding convex part, which is opposite to the second sliding convex part across the second sliding surface, toward a direction of the second sliding surface.

Thus, it is possible to certainly ensure that the carriage 5 mounted on both the guide members 22, 23 is linearly moved along the second sliding surface.

In the image recording apparatus 1, ink is supplied from an ink storage part provided at a stationary position of a main body of the image recording apparatus through a flexible ink supply tube connected to the carriage 5, and the second guide member 23 close to a place where the ink supply tube is coupled to the carriage includes the second sliding surface.

Accordingly, since the one guide member on which an influence of the connection of the ink supply tube to the carriage is easily exerted is provided with the second sliding surface 54, there is obtained an effect that the contact state of the second sliding convex part to the second sliding surface can be ensured.

Further, the coming-out preventing pawl is disposed outside of a recording range of the recording head with respect to the recording medium P.

Therefore, the operation position where the carriage 5 is detached from both the guide members is made close to the standby position of the carriage, and the movement distance of the carriage 5 can be made small.

Also, the carriage 5 includes an adjustment unit to adjust a protrusion amount of the second sliding convex part.

Thus, there is obtained an effect that the adjustment of the posture of the carriage 5 to optimize the picture quality of recording can be carried out in the state where the carriage is fitted to both the guide members 22, 23, and the adjustment operation becomes easy.

In addition, the sliding surface of at least one of the first and second sliding convex parts includes a concave groove 58 for holding lubricating grease.

Therefore, there is obtained an effect that the friction resistance of the guide member to the sliding surface can be decreased, the occurrence of an abnormal sound and the consumption energy for movement of the carriage can be reduced, and the carriage 5 can be lightly slid while it does not apply a forcible force to the guide member.

Further, the first sliding convex parts are disposed at respective apexes of a triangle extending over the first and second guide members 22, 23.

Since the carriage is supported on both the guide members 22, 23 through the so-called three-point support, there is obtained an effect that the posture of the carriage 5 can be stabilized.

Additionally, when the carriage 5 comes in slide contact with the first and second guide members 22, 23, the coming-out preventing pawl is out of contact with the first and second guide members.

Since the coming-out preventing pawl is out of contact with both the guide members 22, 23 at the time of the movement of the carriage, there is obtained an effect that a forcible force is not applied to the guide members, and the carriage 5 can be slid further lightly.

Also, the coming-out preventing pawl is disposed at a position where the coming-out preventing pawl can come in contact with the first and second guide members 22, 23 when the carriage 5 receives an external force from a surface side of the recording head.

Therefore, even if an external force is applied to the recording head at the time of a maintenance operation, there is no such fear that the carriage 5 is tilted, and there is obtained an effect that the maintenance operation can be carried out without fail.

Further, the sliding surfaces of the first and second sliding convex parts are formed to be convex curved surfaces in the main scanning direction of the carriage 5.

Thus, the first and second sliding convex parts come in line contact with the first and second sliding surfaces, and the carriage 5 can be lightly moved. Further, even when the protrusion amount of the one second sliding convex part is changed and the posture of the carriage is adjusted, the two second sliding convex parts can come in contact with the second sliding surface without fail, and there is obtained an effect that the posture adjustment of the carriage 5 can be accurately performed.

In the image recording apparatus 1, after the carriage 5 is primarily molded of synthetic resin material, portions where the sliding surfaces of the first and second sliding convex parts are formed are outsert-molded.

Therefore, it is possible to easily select materials which meet design requirements for the strength of the carriage 5 itself, deformation prevention and the like, and different demands for wear resistance requested in the sliding convex part, small friction coefficient and the like, and there is obtained an effect that the durability of the carriage is improved, and the improvement of the quality of the image recording apparatus can be easily attained.

Also, the sliding surfaces of the first and second sliding convex parts of the carriage are set to act as a reference of a nozzle surface at a time when the recording head is fitted to the carriage 5, as a frame reference, and as a reference at a time of scanning.

Since the reference position or the reference surface having a direct influence on the quality of image recording can be regulated by the first and second sliding convex parts provided on the carriage, there is obtained an effect that the assembly of the image recording apparatus 1 can be improved and simplified.

Also, an attachment position of a belt to move the carriage 5 in the main scanning direction is set to be higher than a height position of both ends of the belt in the main scanning direction.

When the carriage 5 is moved in the main scanning direction, it is possible to certainly prevent the carriage from floating above both the guide members, and there is obtained an effect that the quality of a recording image can be kept constant.

In the image recording apparatus 1, at least the two coming-out preventing pawls are disposed to be spaced suitably apart from each other along the main scanning direction of the carriage, and the notch parts whose number and arrangement interval are equal to the number and the arrangement interval of the coming-out preventing pawls are provided in the first and second guide members 22, 23 so that when the carriage 5 is detached in the direction crossing the main scanning direction, all the coming-out preventing pawls can be simultaneously detached from the first and second guide members.

Since at least the two coming-out preventing pawls prevent the carriage 5 from floating relative to the main scanning direction of the respective guide members 22, 23, the posture of the carriage is not carelessly changed, and especially, even if an external force is applied from below at the time of maintenance, there does not occur such a disadvantage that the carriage is tilted. Besides, when the carriage is detached from both the guide members, the detachment of the carriage 5 and the mounting posture can be regulated so that all the coming-out preventing pawls come out from all the notch parts at the same time, and it is possible to certainly prevent the respective parts of the image recording apparatus from being carelessly damaged or broken at the time of an exchange operation of the carriage.

Further, a closing member to prevent the coming-out preventing pawl from coming off in a detaching direction of the carriage 5 is detachably attached to at least one of the notch parts.

Thus, the carriage 5 does not carelessly detach from the guide member at the normal operation time other than the exchange operation of the carriage.

Also, an encoder strip long along the movement direction of the carriage 5 is disposed such that its detected surface is parallel to the second sliding surface of the second guide member, the respective notch parts of the second guide member are formed to lie astride the first sliding surface and the second sliding surface, and the coming-out preventing pawl is set to be positioned at a height position of the notch part on a side of the second sliding surface at a time when the carriage moves in the detaching direction and in a state where the encoder strip comes out of the carriage 5.

Since the exchange operation of the carriage 5 can be carried out without detaching the encoder strip, there is obtained an effect that the operation can be easily performed. Besides, since the encoder strip is not detached, a subsequent adjustment operation of a movement position of the carriage becomes unnecessary.

Furthermore, a detachable/attachable lid cover body is provided on an upper surface of the carriage 5, and the lid cover body includes, at a place different from the coming-out preventing pawl, a blocking pawl to prevent the lid cover body from detaching from one guide member of the first and second guide members at a time when the carriage is moved in a detaching direction.

Thus, the lid cover body has a function to press the upper side of the flexible flat cable, the carriage cannot be detached/attached at the position where the lid cover can be detached/attached, and the lid cover body cannot be detached/attached at the position where the carriage can be detached/attached. Thus, there is obtained an effect that it is possible to prevent the carriage 5 from being easily detached/attached from/to the guide member.

The foregoing description of the preferred embodiments of the invention has been presented for purposes of illustration and description. It is not intended to be exhaustive or to limit the invention to the precise form disclosed, and modifications and variations are possible in light of the above teachings or maybe acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image recording apparatus comprising:

a first guide member disposed at an upstream side in a transportation direction of a recording medium, the first guide member having a substantially horizontal upper surface that includes a first sliding surface;

a second guide member disposed at a downstream side in the transportation direction, the second guide member having a substantially horizontal upper surface that includes another first sliding surface; and a carriage on which a recording head capable of recording an image on the recording medium is mounted and which reciprocates in a main scanning direction, the carriage being supported by the first sliding surfaces of the first and second guide members which are parallel to a head surface of the recording head, the carriage including first sliding convex parts protruding from a lower surface side thereof and coming in contact with the first sliding surfaces of the first and second guide members, and a coming-out preventing pawl disposed to hold at least one of the first and second guide members in cooperation with the first sliding convex part;

wherein at least one of the first and second guide members includes a notch part at a specified position, and the carriage is detachable from the first and second guide members by causing the coming-out preventing pawl to pass through the notch part.

2. The image recording apparatus according to claim 1, wherein one of the first and second guide members includes a second sliding surface provided to stand substantially orthogonally to the first sliding surface; and the carriage includes a second sliding convex part which comes in sliding contact with the second sliding surface, and an elastic member to elastically urge a third sliding convex part, which is opposite to the second sliding convex part across the second sliding surface, toward a direction of the second sliding surface.

3. The image recording apparatus according to claim 2, wherein ink is supplied from an ink storage part fixed in a main body of the image recording apparatus through a flexible ink supply tube connected to the carriage; and the second guide member close to a place where the ink supply tube is coupled to the carriage includes the second sliding surface.

4. The image recording apparatus according to claim 1, wherein the coming-out preventing pawl is disposed outside of a recording range of the recording head with respect to the recording medium.

5. The image recording apparatus according to claim 2, wherein the carriage includes an adjustment unit to adjust a protrusion amount of the second sliding convex part.

6. The image recording apparatus according to claim 2, wherein a sliding surface of at least one of the first and second sliding convex parts includes a concave groove for holding lubricating grease.

7. The image recording apparatus according to claim 2, wherein the first sliding convex parts are disposed at respective apexes of a triangle extending over the first and second guide members.

8. The image recording apparatus according to claim 1, wherein when the carriage comes in sliding contact with the first and second guide members, the coming-out preventing pawl is out of contact with the first and second guide members.

9. The image recording apparatus according to claim 1, wherein the coming-out preventing pawl is disposed at a position where the coming-out preventing pawl is capable of coming in contact with at least one of the first and second guide members when the carriage receives an external force from a surface side of the recording head.

10. The image recording apparatus according to claim 2, wherein a sliding surfaces of the first and second sliding convex parts are formed to be convex curved surfaces in the main scanning direction of the carriage.

11. The image recording apparatus according to claim 2, wherein after the carriage is primarily molded of synthetic resin material, portions which constitutes the sliding surfaces of the first and second sliding convex parts are outsert-molded.

12. The image recording apparatus according to claim 1, wherein the sliding surfaces of the first and second sliding convex parts of the carriage are set to act as a reference for a nozzle surface at a time when the recording head is fitted to the carriage, as a frame reference, and as a reference at a time of scanning.

13. The image recording apparatus according to claim 1, wherein an attachment position of a belt for moving the carriage in the main scanning direction with respect to the carriage is set to be higher than a height position of both ends of the belt in the main scanning direction.

14. An image recording apparatus comprising:

a first guide member disposed at an upstream side in a transportation direction of a recording medium which is orthogonal to a main scanning direction, the first guide member having a substantially horizontal upper surface that includes a first sliding surface;

a second guide member disposed at a downstream side in the transportation direction, the second guide member having a substantially horizontal upper surface that includes another first sliding surface and a second sliding surface provided to stand substantially orthogonally to the first sliding surface; and a carriage on which a recording head capable of recording an image on the recording medium is mounted and which reciprocates in the main scanning direction, the carriage being supported by the first sliding surfaces of the first and second guide members which are parallel to a head surface of the recording head, the carriage including first sliding convex parts protruding from a lower surface side thereof and coming in contact with the first sliding surfaces of the first and second guide members, coming-out preventing pawls disposed to hold the first and second guide members in cooperation with the respective first sliding convex parts, a second sliding convex part coming in sliding contact with the second sliding surface, a third sliding convex part that is opposite to the second sliding convex part across the second sliding surface, and an elastic member to elastically urge the third sliding convex part toward a direction of the second sliding surface;

wherein the first and second guide members include, at specified positions, notch parts to enable the respective coming-out preventing pawls to be detached in a direction crossing the main scanning direction of the carriage.

15. The image recording apparatus according to claim 14, wherein at least the two coming-out preventing pawls are disposed to be spaced apart from each other along the main scanning direction of the carriage; and the notch parts whose number and arrangement interval are equal to the number and the arrangement interval of the coming-out preventing pawls are provided in the first and second guide members, and when the carriage is detached in the direction crossing the main scanning direction, all the coming-out preventing pawls can be simultaneously detached from the first and second guide members.

16. The image recording apparatus according to claim 14, wherein a closing member to prevent the coming-out preventing pawl from coming out in a detaching direction of the carriage is detachably attached to at least one of the notch parts.

17. The image recording apparatus according to claim 14, wherein an encoder strip long along a movement direction of the carriage is disposed, a detected surface of which is parallel to the second sliding surface of the second guide member; and the respective notch parts of the second guide member are formed to lie astride the first sliding surface and the second sliding surface, and the coming-out preventing pawl is set to be positioned at a height position of the notch part on a side of the second sliding surface at a time when the carriage moves in the detaching direction and in a state where the encoder strip comes out of the carriage.

18. The image recording apparatus according to claim 14, wherein a detachable and attachable lid cover body is provided on an upper surface of the carriage, and the lid cover body includes, at a place different from the coming-out preventing pawl, a blocking pawl to prevent the lid cover body from detaching from one of the first and second guide members at a time when the carriage is moved in a detaching direction.

* * * * *